US012168867B1

(12) United States Patent
MacKarvich

(10) Patent No.: US 12,168,867 B1
(45) Date of Patent: Dec. 17, 2024

(54) BUILDING STABILIZATION SYSTEM

(71) Applicant: Charles J. MacKarvich, Atlanta, GA (US)

(72) Inventor: Charles J. MacKarvich, Atlanta, GA (US)

( * ) Notice: Subject to any disclaimer, the term of this patent is extended or adjusted under 35 U.S.C. 154(b) by 0 days.

(21) Appl. No.: 18/734,450

(22) Filed: Jun. 5, 2024

Related U.S. Application Data

(60) Provisional application No. 63/625,692, filed on Jan. 26, 2024.

(51) Int. Cl.
*E04B 1/343* (2006.01)

(52) U.S. Cl.
CPC ..... *E04B 1/34352* (2013.01); *E04B 1/34347* (2013.01)

(58) Field of Classification Search
None
See application file for complete search history.

(56) References Cited

U.S. PATENT DOCUMENTS 3,750,349 A * 8/1973 Deike ..... B60P 3/32 248/354.3
3,828,491 A * 8/1974 Koon ..... E04B 1/34347 52/157
3,914,910 A * 10/1975 Struben ..... E02D 5/805 52/DIG. 11
3,937,436 A * 2/1976 Stewart ..... E04B 1/34347 52/155
4,148,162 A * 4/1979 Goodrich ..... E04B 1/34336 280/764.1
4,180,952 A * 1/1980 Vanderlyn ..... E04B 1/34347 52/166
4,417,426 A * 11/1983 Meng ..... E04B 1/34352 52/167.3
5,697,191 A * 12/1997 MacKarvich ..... E02D 27/34 52/146
5,797,226 A * 8/1998 MacKarvich ..... E02D 27/02 52/155
5,850,718 A * 12/1998 MacKarvich ..... E02D 27/02 52/695
6,128,867 A * 10/2000 MacKarvich ..... E02D 5/801 52/157
6,256,940 B1 * 7/2001 MacKarvich ..... E04B 1/34352 52/126.6
6,381,907 B1 * 5/2002 MacKarvich ..... E04B 1/34352 52/126.6
10,774,495 B2 * 9/2020 Oliver ..... E02D 27/48
11,319,691 B2 * 5/2022 Oliver ..... E04B 1/34347
11,499,327 B1 * 11/2022 MacKarvich ..... E04G 21/3242
2002/0095880 A1 * 7/2002 MacKarvich ..... E04B 1/34352 52/693
2002/0170253 A1 * 11/2002 MacKarvich ..... E02D 27/02 52/155
2009/0038240 A1 * 2/2009 Leonard ..... E04B 1/34347 52/169.9

* cited by examiner

*Primary Examiner* — Joshua K Ihezie
(74) *Attorney, Agent, or Firm* — Buchalter

(57) ABSTRACT

A home stabilization system includes a base assembly configured to be mounted to a ground; a lateral transfer strut configured to be pivotably coupled to a manufactured home at a first transfer strut end and pivotably coupled to the base assembly at an opposite second transfer strut end; and a vertical brace configured to be pivotably coupled to a manufactured home at a first vertical brace end and pivotably coupled to the base assembly at an opposite second vertical brace end.

23 Claims, 19 Drawing Sheets

BUILDING STABILIZATION SYSTEM

CROSS-REFERENCE TO RELATED APPLICATIONS

The present application claims the benefit of U.S. Provisional Application No. 63/625,692, filed Jan. 26, 2024, which is hereby specifically incorporated by reference herein in its entirety.

TECHNICAL FIELD

This disclosure relates to disclosure relates to manufactured buildings. More specifically, this disclosure relates to stabilization system for a manufactured home.

BACKGROUND

Manufactured buildings, including manufactured homes, are typically pre-fabricated at a factory or other manufacturing facility and then transported to and installed at a residence or other property site. The manufactured building must be properly anchored to the ground to prevent the building from being lifted, blown away, or otherwise moved during hazardous weather events, such as high winds or seismic activity. In such hazardous conditions, inadequate anchoring can be extremely dangerous for occupants and/or neighbors and can result in damage to the building and/or surrounding property.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a home stabilization system comprising a base assembly configured to be mounted to a ground; a lateral transfer strut configured to be pivotably coupled to a manufactured home at a first transfer strut end and pivotably coupled to the base assembly at an opposite second transfer strut end; and a vertical brace configured to be pivotably coupled to a manufactured home at a first vertical brace end and pivotably coupled to the base assembly at an opposite second vertical brace end.

Additionally, disclosed is a building assembly comprising a manufactured building mounted above ground and defining a first lateral side and a second lateral side; and a stabilization system mounted between the manufactured building and the ground, the stabilization system comprising a plurality of stabilization assemblies, each stabilization assembly comprising: a base assembly configured to be mounted to the ground; a lateral transfer strut pivotably coupled to the manufactured home and pivotably coupled to the base assembly; and a vertical brace pivotably coupled to the manufactured home and pivotably coupled to the base assembly.

Additionally, disclosed is a method of a manufactured building above ground, the method comprising mounting a base assembly of a first stabilization assembly to the ground; mounting a base assembly of a second stabilization assembly to the ground; attaching the first stabilization assembly to a first lateral side of the manufactured building; attaching the second stabilization assembly to a second lateral side of the manufactured building.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
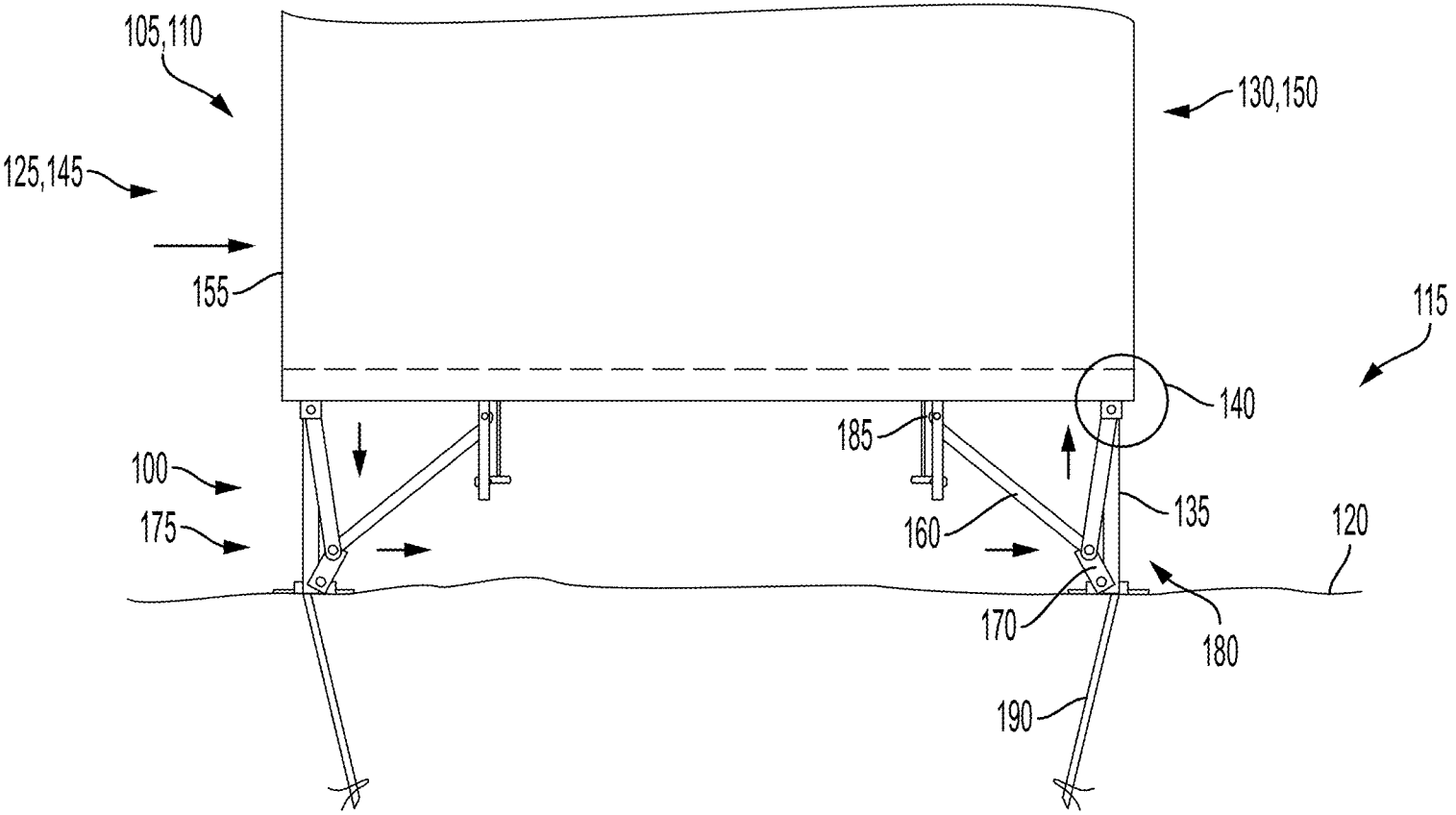
FIG. 1 is a front view of a home stabilization system for anchoring a manufactured home to the ground, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a home stabilization system and associated methods, systems, devices, and various apparatus. Example aspects of the home stabilization system can a lateral transfer strut configured to connect to a manufactured building. It would be understood by one of skill in the art that the home stabilization system is described in but a few exemplary embodiments among many. No particular terminology or description should be considered limiting on the disclosure or the scope of any claims issuing therefrom.

FIG. 1 is a front view of a home stabilization system 100 for a manufactured building 105, in accordance with one aspect of the present disclosure. In in the present aspect, the manufactured building 105 can be a manufactured home 110. In other aspects, the manufactured building 105 can be any other suitable building, such as an office building for example and without limitation. The manufactured home 110 can be pre-fabricated at a factory or other manufacturing facility and can then be transported to and installed at a residential property 115.

As shown, the home stabilization system 100 can be configured to anchor the manufactured home 110 to the ground 120 at the residential property 115. Example aspects of the home stabilization system 100 can comprise one or more toggle assemblies 170. The home stabilization system 100 can further comprise one or more longitudinal braces 135 that can be attached to upper brace brackets 410 (shown in FIG. 4) mounted onto the inside of an interface 140 between a rim joist 250 (shown in FIG. 2) and a floor joist 255 (shown in FIG. 2). The longitudinal brace 135 can be a tube or tube assembly, a bar, a rod, or any other strut as desired. Further, the tubes, bars, rods, or other struts can be formed from metal, such as steel, and can be formed by extrusion or any other desired method.

The home stabilization system 100 can be attached to opposing lateral sides 145,150 (e.g., the windward side 125 and the leeward side 130) of the manufactured home 110. That is, a first stabilization assembly 175 can be attached to the manufactured home 110 at the first lateral side 145 (e.g., the windward side 125), and a second stabilization assembly 180 can be attached to the manufactured home 110 at the second lateral side 150 (e.g., the leeward side 130). When the wind loads on the windward side 125 of the manufactured home 110 start to impact on side walls 155 of the manufactured home 110, the manufactured home 110 can want to move laterally as well as move upward at the windward side 125 as a result of uplift loads. For example, when horizontal lateral wind loads are applied to the windward side 125, the manufactured home 110 can want to shift laterally. Each of the first and second home stabilization assemblies 175,180 can comprise a lateral transfer strut 160 that can be attached to a frame 185 of the manufactured home 110 and also connected to the corresponding toggle assembly 170. As shown, the lateral transfer strut 160 can be a tube assembly comprising two or more tubes attached to each other with fasteners, such as with one tube nested in another tube. In other aspects, the lateral transfer strut 160 can be a single tube, a bar, a rod, or any other strut as desired. Further, the tubes, bars, rods, or other struts can be formed from metal, such as steel, and can be formed by extrusion or any other desired method. The lateral transfer strut 160 can be, upon installation, arranged at about a 45-degree angle relative to the floor joist 255 and the rim joist 250 and at about a 45-degree angle relative to the ground 120, although the angle of the lateral transfer strut 160 can vary. According to example aspects, the lateral transfer strut 160 at the leeward side 130 of the manufactured home 110 can transfer the lateral loads to the toggle assembly 170 at the leeward side 130. Further, the lateral transfer strut 160 can be configured to pivot within a range of angles above and below the installed angle, which is 45 degrees in some aspects, such as when the manufactured home is under a wind load.

Further, any number of stabilization assemblies 175,180 can be present in various aspects of the current disclosure. In some aspects, such as when the manufactured home 110 has walls of approximately equal length, the stabilization system 100 can comprise two stabilization assemblies 175 on one side of the manufactured home 110 and two stabilization assemblies 180 on an opposite side of the manufactured home 110, with each stabilization assembly positioned proximate to a respective corner of the manufactured home 110. In other aspects, more stabilization assemblies 175,180 can be present. For example and without limitation, when lateral wind load is expected to be greater in one direction, even with manufactured homes with walls of equal length, the stabilization system could comprise three or more stabilization assemblies 175 on one lateral side 145 of the manufactured home 110 and three or more stabilization assemblies 180 on the opposite lateral side 150 of the manufactured home 110. In aspects where the lateral sides 145,150 of the manufactured home 110 are longer than the remaining sides or ends of the manufactured home 110 and, in some aspects, wind loads are thereby expected to be greater on the lateral sides 145,150, more stabilization assemblies 175,180 may be desired along the length of the lateral sides 145,150 than along the reaming sides or ends of the manufactured home 110. Additionally, in some aspects, wind loads may blow in both directions, such that the windward side 125 and the leeward side 130 switch between sides 145,150, depending on the direction of the wind, or may even switch from the sides 145,150 to the remaining sides or ends of the manufactured home 110. In such aspects, the longitudinal braces 135 can act in a similar manner to the lateral transfer struts 160 to translate wind loads on the manufactured home 110, as described below. Further, because wind loads on the remaining sides or ends of the manufactured home 110 are typically less than wind loads on the lateral sides 145,150, longitudinal braces 135 may not be present in some or all of the stabilization assemblies 175,180. For example and without limitation, in aspects with three stabilization assemblies 175 on one lateral side 145 and three stabilization assemblies 180 on the other lateral side 150, the stabilization assemblies 175,180 positioned proximate to midpoints of the lateral sides 145,150 can comprise longitudinal braces 135, while the remaining stabilization assemblies 175,180 do not comprise longitudinal braces 135. Alternatively, stabilization assemblies 175,180 proximate to ends of the lateral sides 145,180, such as at corners of the manufactured home 110, can comprise longitudinal braces 135, while the remaining stabilization assemblies 175,180 do not comprise longitudinal braces 135.

Figure 2:
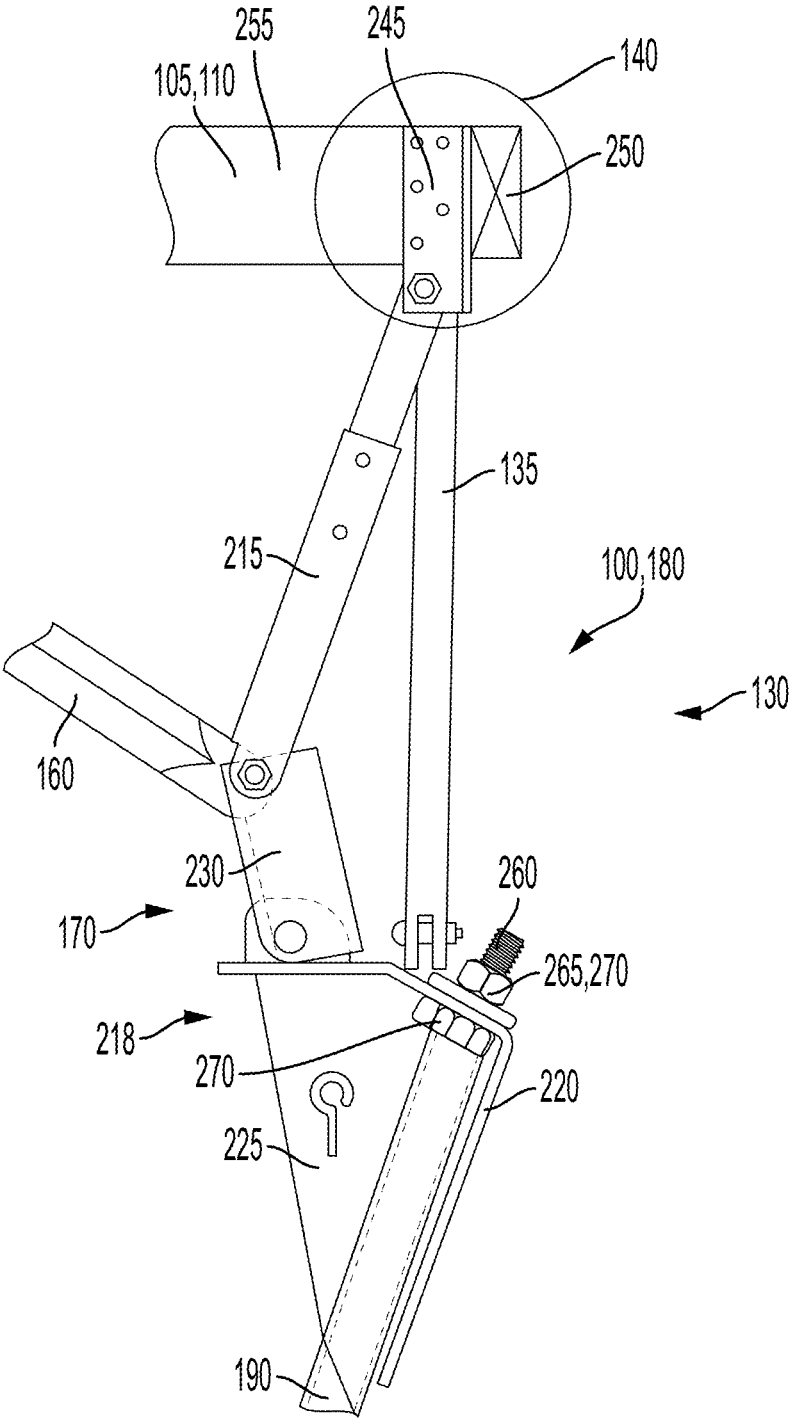
FIG. 2 is a detail front view of a stabilization assembly of the home stabilization system of FIG. 1.
Figure 4:
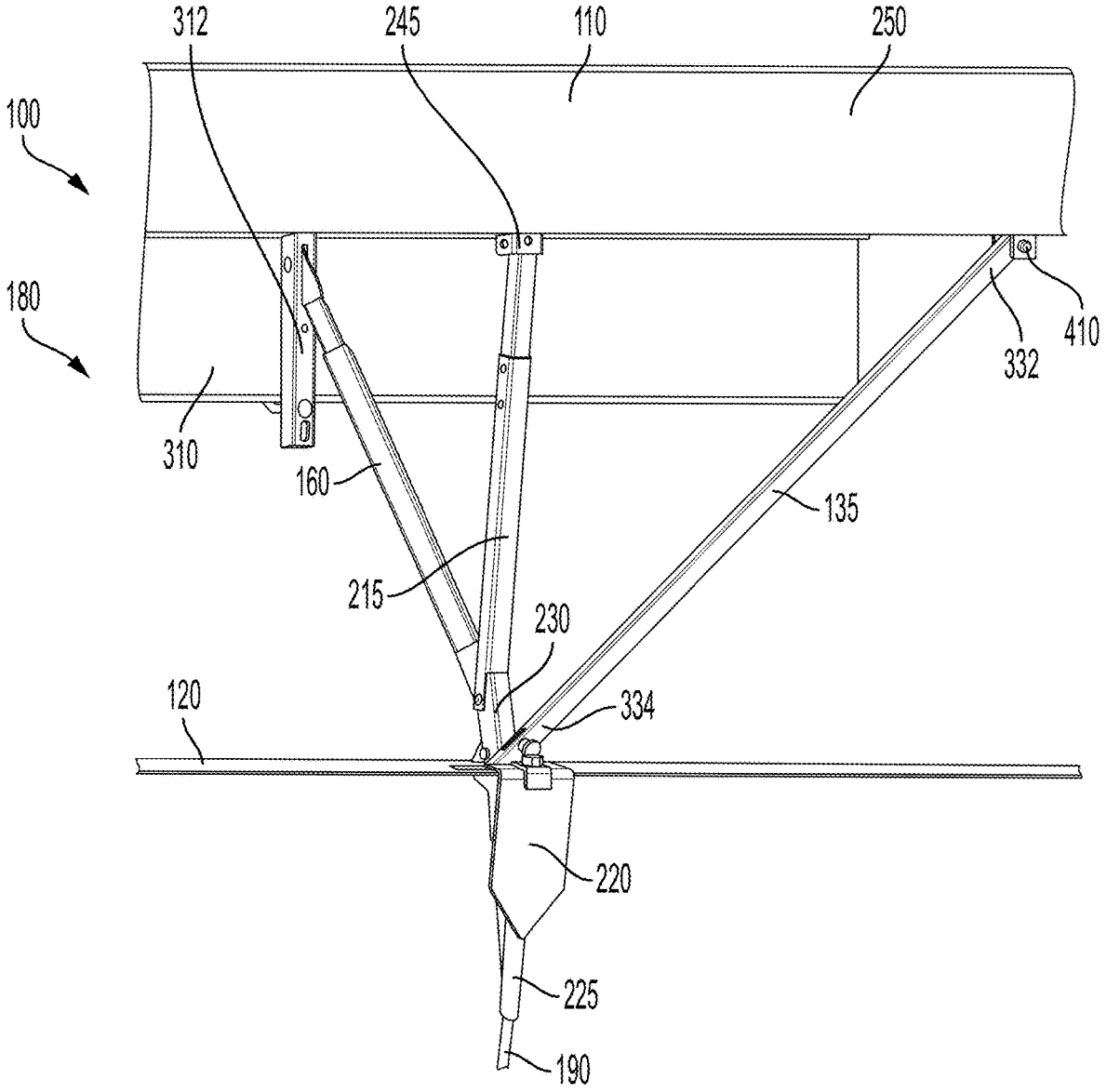
FIG. 4 is a perspective view of the stabilization assembly of FIG. 3.
Figure 5:
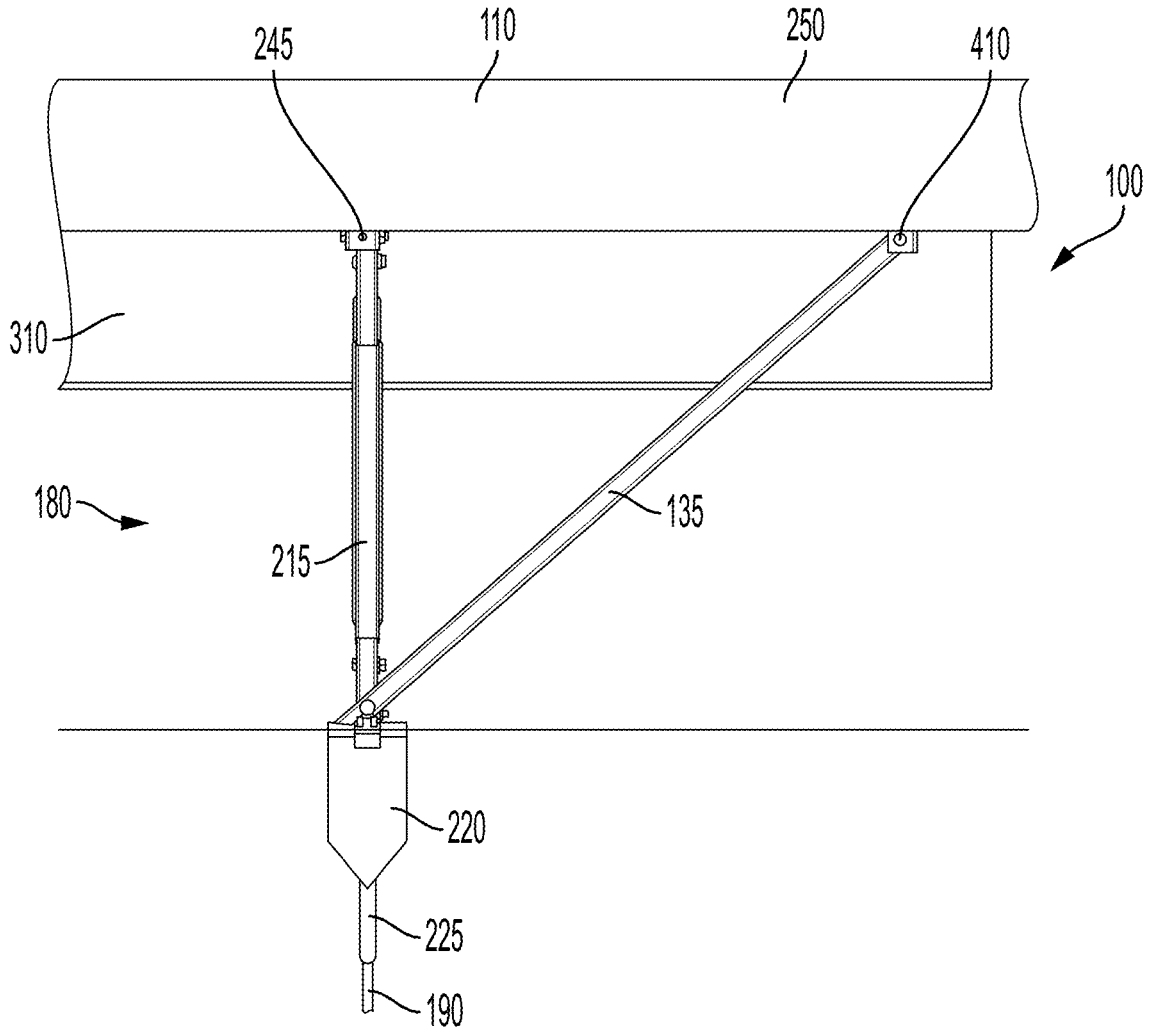
FIG. 5 is a right-side view of the stabilization assembly of FIG. 3.

Referring now to FIG. 2, the longitudinal brace 135 can be mounted at approximately a 45-degree angle relative to the floor joist 255 and the rim joist 250 (as best seen in FIGS. 4 and 5) and at a 45-degree angle relative to the ground 120, although the angle of the longitudinal braces 135 can vary. Further, the longitudinal braces 135 can be configured to pivot within a range of angles above and below the installed angle, which is 45 degrees in some aspects, such as when the manufactured home is under a wind load in a longitudinal direction relative to the manufactured home 110. Example aspects of the home stabilization system 100 can further comprise the toggle assembly 170 incorporated into the vertical tubular components of the home stabilization system 100. In some aspects, an optional vertical brace 215 can be attached to a base assembly 218 of a stabilizer plate 220 and a curl bracket 225. As shown, the vertical brace 215 can be a tube assembly comprising two or more tubes attached to each other with fasteners, such as with one tube nested in another tube. In other aspects, the vertical brace 215 can be a single tube, a bar, a rod, or any other strut as desired. Further, the tubes, bars, rods, or other struts can be formed from metal, such as steel, and can be formed by extrusion or any other desired method.

The vertical brace 215 can be attached to the base assembly 218 with a lower toggle bracket 230 at an anchor connection point. The anchor connection point can be a point where an anchor rod 190 (shown in both FIGS. 1 and 2) extending substantially downward into the ground 120 can connect to the base assembly 218 of the curl bracket 225 and the stabilizer plate 220. The vertical brace 215 can further be attached to the manufactured home 110 by an upper bracket 245 (shown in FIG. 2) mounted onto the inside of an interface 140 between the rim joist 250 and the floor joist 255. In example aspects, the vertical brace 215 can be mounted relative to the floor joist 255 and the rim joist 250 at an angle of about 90° or less. The vertical brace 215 can be arranged at about 90° or less relative to the ground 120. As shown, the vertical brace 215 may not be perfectly vertical (i.e. 90 degrees to the ground 120 or the manufactured home 110 or a horizontal direction). In some aspects, the vertical brace 215 can be oriented at a smaller angle that is equal to or greater than zero degrees relative to a vertical direction than an angle of the lateral transfer strut 160, such that the vertical brace 215 provides more support in a vertical direction than the lateral transfer strut 160, and the lateral transfer strut 160 provides more support in a lateral or horizontal direction than the vertical brace 215.

When the lateral transfer strut 160 transfers the lateral loads to the toggle assembly 170 at the leeward side 130 of the manufactured home 110 (i.e., the toggle assembly 170 of the second stabilization assembly 180), the toggle assembly 170 can force the corresponding vertical brace 215 upward, which in turn can support the leeward side 130 of the manufactured home 110. Thus, these support loads on the leeward side 130 of the manufactured home 110 can reduce the uplift loads by a similar load. The first stabilization assembly 175 of the home stabilization system 100 located at the opposing windward side 125 of the manufactured home 110 can provide downward forces to the windward side 125 similar to the opposing support loading provided by the second stabilization assembly 180 at the leeward side 130.

In addition, the stabilizer plate 220 and the curl bracket 225 can also provide a compressive load against the soil of the ground 120 that can negate the horizontal lateral and longitudinal loads against the side walls 155 and end walls of the manufactured home 110. The same downward forces on the second stabilization assembly 180 at the leeward side 130 of the manufactured home 110 can also be transferred to one or more anchor helixes 350 (shown in FIG. 3) coupled to the anchor rod 190. Further, lateral loads from the lateral transfer strut 160 can be translated to vertical loads, such as uplift forces on the windward side 125 and downward forces on the leeward side 130, which are countered by the anchor 190 and anchor helixes 350 and by the compressive load against the soil of the ground 120 by the stabilizer plate 220, respectively. Further, uplift forces on the windward side 125 can be translated in substantial amounts to lateral loads on the stabilizer plate 220 and thereby against the soil of the ground 120, both on the windward side 125 and the leeward side 130. The stabilizer plate 220 therefore reduces the bending moment on the anchor rod 190 from lateral loads, allowing for lesser penetration depth (e.g. shorter anchor rods 190) than may otherwise be required. Further, longitudinal loads can translate along the longitudinal brace 135 to the curl bracket 225 and thereby against the soil of the ground 120, likewise reducing the bending moment on the anchor rod 190 from longitudinal loads.

As shown, the anchor rod 190 can comprise a threaded end portion 260. In example aspects, a fastener or fastener assembly 265, such as a pair of threaded hex nuts 270 for example and without limitation, can be threaded onto the threaded end portion 260 of the anchor rod 190 at either side of the stabilizer plate 220. In some aspects, each of the threaded hex nuts 270 can be affixed to the stabilizer plate 220. The fastener assembly 265 of the two opposing threaded hex nuts 270 can support vertical compression and vertical pull out loads. According to example aspects, the threaded hex nuts 270 at the leeward side 130 of the manufactured home 110 can allow an anchor installation machine to reverse rotate the anchor rod 190 back out at the fastener assembly 265.

Figure 3:
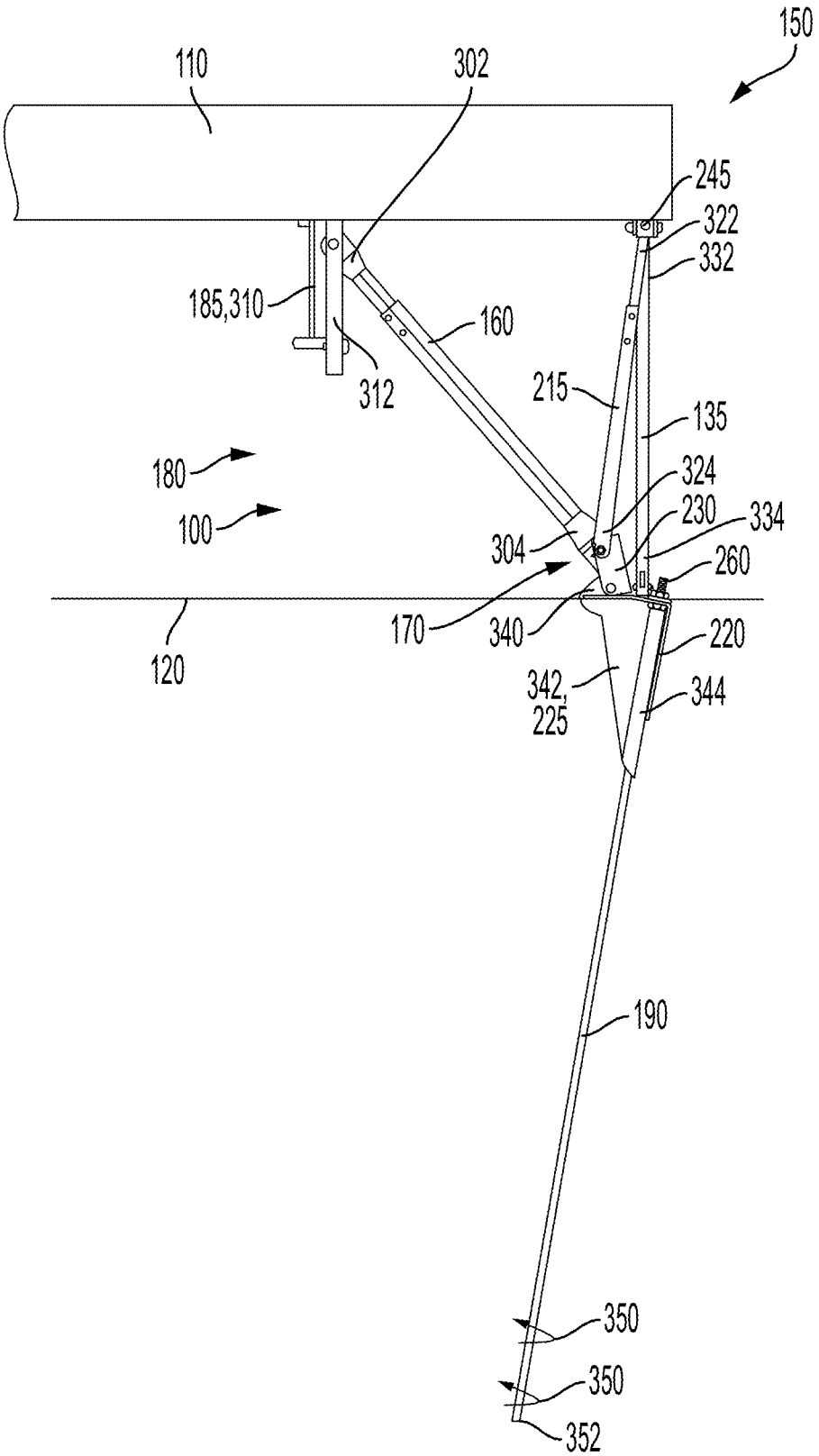
FIG. 3 is a front view of the stabilization assembly of the home stabilization system, according to another aspect of the present disclosure.

FIG. 3 is a front view of the home stabilization system 100 that can anchor the manufactured home 110 to the ground 120. Example aspects of the home stabilization system 100 can comprise one or more the stabilization assemblies (e.g., the first stabilization assembly 175 and the second stabilization assembly 180). The second stabilization assembly 180 is shown in the present view, which can also be representative of the first stabilization assembly 175 (shown in FIG. 1). The second stabilization assembly 180 can be attached to the manufactured home 110 at the second lateral side 150 (e.g., the leeward side 130) of the manufactured home 110. Example aspects of the second stabilization assembly 180 can comprise the lateral transfer strut 160 that can be pivotably attached to the frame 185 of the manufactured home 110 at a first transfer strut end 302 thereof. For example, in the present aspect, the lateral transfer strut 160 can be attached to an I-beam 310 of the frame 185 by a beam brace 312. The lateral transfer strut 160 can further be pivotably attached to the toggle assembly 170 of the second stabilization assembly 180 at an opposing second transfer strut end 304 thereof. More specifically, the lateral transfer strut 160 can be pivotably attached to the lower toggle bracket 230 at the second transfer strut end 304.

The second stabilization assembly 180 can further comprise the vertical brace 215 that can be pivotably attached to the manufactured home 110 by the upper bracket 245 at a first vertical brace end 322 thereof. The vertical brace 215 can further be pivotably attached to the toggle assembly 170 of the second stabilization assembly 180 at an opposing second vertical brace end 324 thereof. More specifically, the vertical brace 215 can be pivotably attached to the lower toggle bracket 230 at the second vertical brace end 324. According to example aspects, the second stabilization assembly 180 can additionally optionally comprise the longitudinal brace 135 that can be attached to the manufactured home 110 by the upper brace bracket 410 (shown in FIG. 4) at a first longitudinal brace end 332 thereof. The longitudinal brace 135 can further be coupled to the stabilizer plate 220 at an opposite second longitudinal brace end 332 thereof.

The second stabilization assembly 180 can comprise the curl bracket 225 and the stabilizer plate 220 mounted to the curl bracket 225. The curl bracket 225 can comprise an upper curl bracket portion 340 arranged above the ground 120 and a lower curl bracket portion 342 arranged below the ground 120. As shown, the lower toggle bracket 230 of the toggle assembly 170 can be pivotably coupled to the upper curl bracket portion 340 of the curl bracket 225. Example aspects of the curl bracket 225 can define a rod sleeve 344 through which an upper rod portion 810 (shown in FIG. 8) of the anchor rod 190 can extend. According to example aspects, the anchor rod 190 can be disposed substantially below the ground 120. However, the threaded end portion 260 of the anchor rod 190, which can be defined by the upper rod portion 810, can extend through and beyond the rod sleeve 344 and can be arranged above the ground 120, as shown. The anchor rod 190 can be coupled to the stabilizer plate 220 by the pair of threaded hex nuts 270 (shown in FIG. 6). In some aspects, one or more of the anchor helixes 350 can be coupled to the anchor rod 190. In example aspects, the anchor helixes 350 can be coupled to the anchor rod 190 proximate to a lower rod end 352 thereof, opposite the threaded end portion 260, and disposed below the ground 120.

FIG. 4 illustrates a perspective view and FIG. 5 illustrates a right-side view of the second stabilization assembly 180 of the home stabilization system 100. As shown, in example aspects, the longitudinal brace 135 can be arranged at about a 45-degree angle relative to the floor joist 255 (shown in FIG. 2) and the rim joist 250, and at about a 45-degree angle relative to the ground 120.

Figure 6:
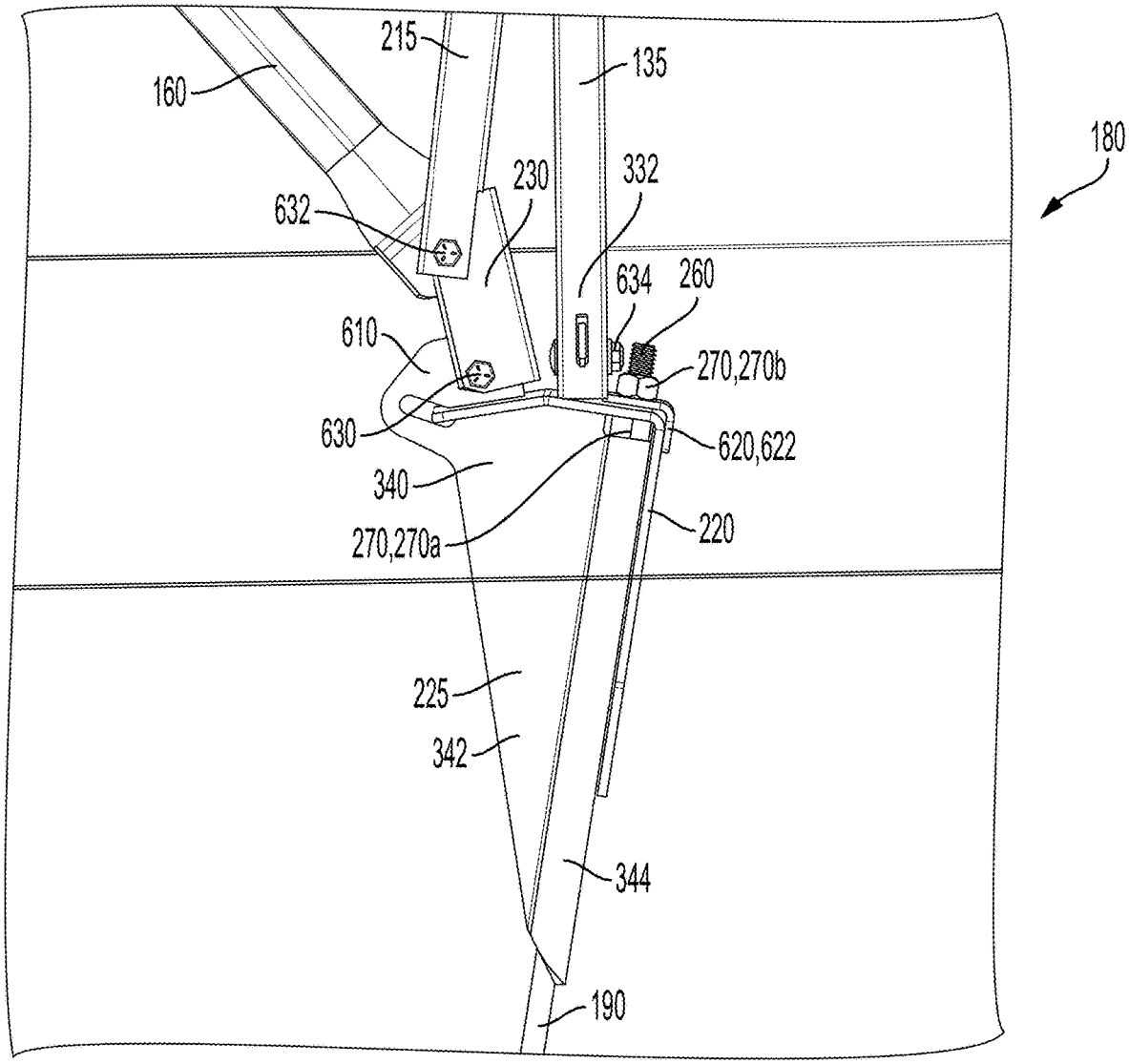
FIG. 6 is a detail front perspective view of the stabilization assembly of FIG. 3.
Figure 7:
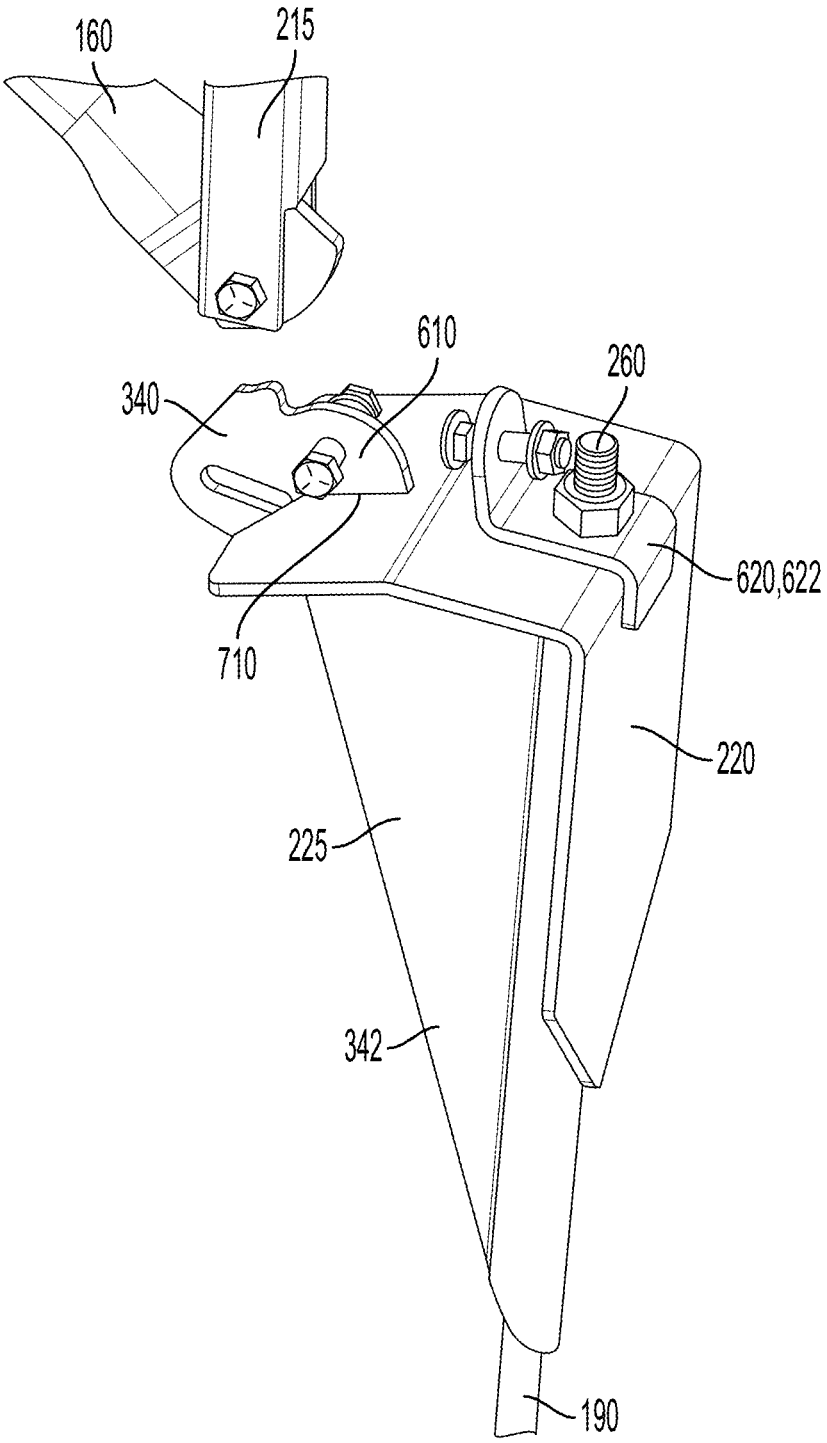
FIG. 7 is a detail perspective view of the stabilization assembly of FIG. 3.

Referring now to FIGS. 6 and 7, the stabilizer plate 220 can engage the upper curl bracket portion 340 of the curl bracket 225. According to example aspects, the stabilizer plate 220 can define a bracket slot 710 (shown in FIG. 7) configured to receive a tab portion 610 of the upper curl bracket portion 340. Furthermore, the lower toggle bracket 230 can be pivotably coupled to the tab portion 610 by a first fastener 630, such as a first nut and bolt assembly, for example and without limitation. Each of the lateral transfer strut 160 and the vertical brace 215 can be pivotably coupled to the lower toggle bracket 230 by a second fastener 632, such as a second nut and bolt assembly, for example and without limitation.

In some example aspects, the second stabilization assembly 180 can further comprise a brace mounting bracket 620 coupled to the stabilizer plate 220. For example, in some aspects, the brace mounting bracket 620 can be a brace mounting weldment 622 that can be welded to the stabilizer plate 220. In example aspects, the longitudinal brace 135 can be coupled to the brace mounting bracket 620 at the second longitudinal brace end 332 thereof by a third fastener 634. The third fastener 634 can be a third nut and bolt assembly, for example and without limitation. The third fastener 634 can extend through a bracket fastener opening 840 (shown in FIG. 8) of the brace mounting bracket 620 and a brace fastener opening 910 (shown in FIG. 9) of the longitudinal brace 135 to couple the longitudinal brace 135 to the brace mounting bracket 620. Additionally, as shown, the threaded end portion 260 of the anchor rod 190 can extend through and beyond both of the stabilizer plate 220 and the brace mounting bracket 620. A first nut 270*a* of the pair of threaded hex nuts 270 can abut the stabilizer plate 220, while a second nut 270*b* of the pair of threaded hex nuts 270 can abut the brace mounting bracket 620.

Figure 8:
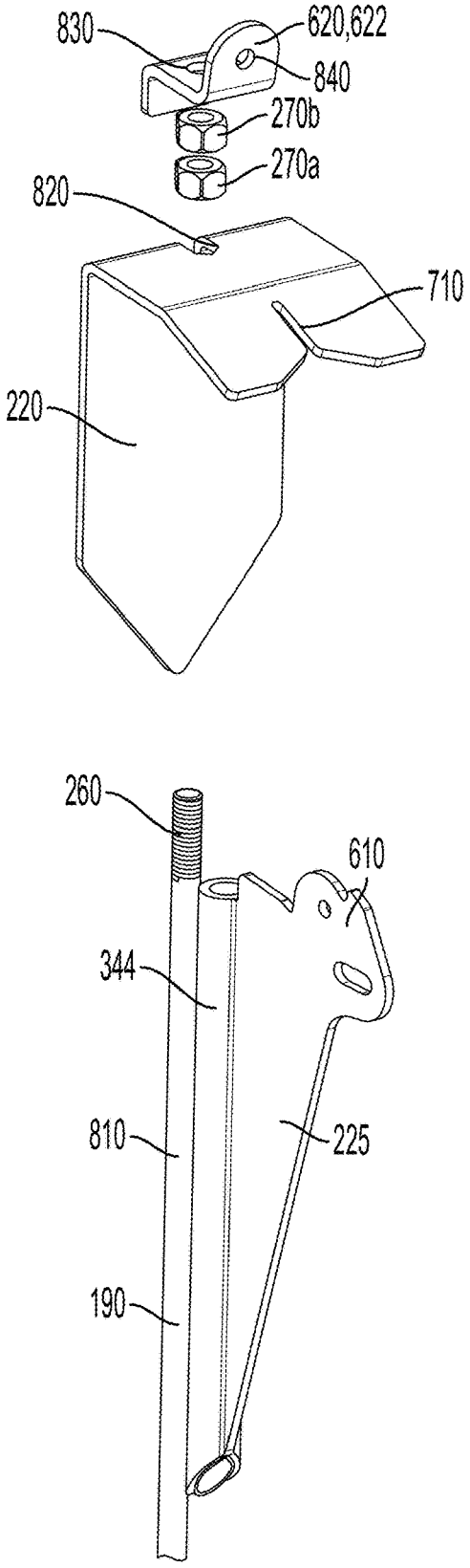
FIG. 8 is an exploded view showing various components of the stabilization assembly of FIG. 3.
Figure 9:
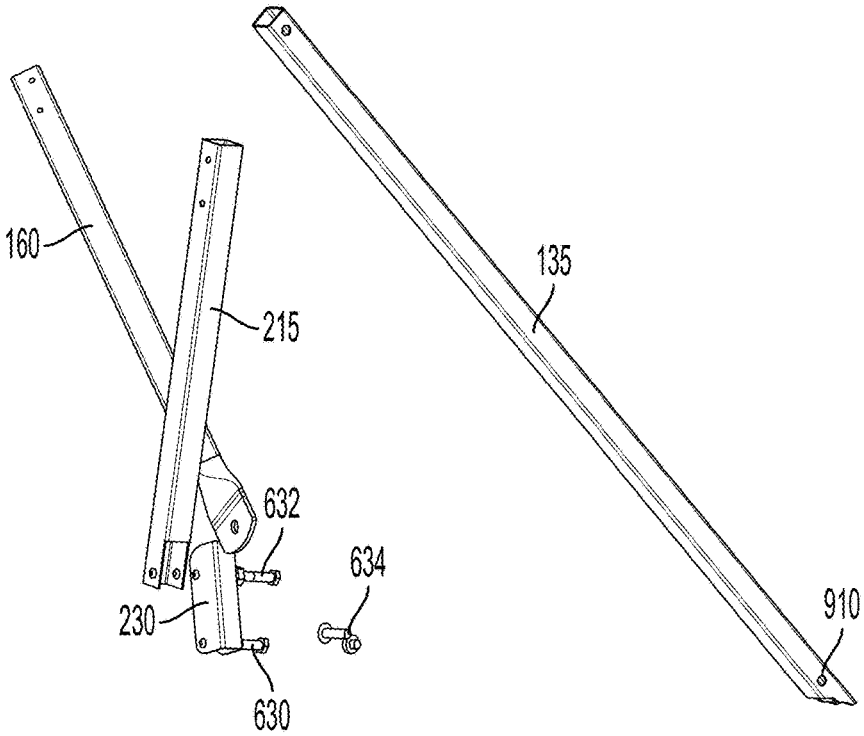
FIG. 9 is an exploded view showing various components of the stabilization assembly of FIG. 3.

FIGS. 8 and 9 illustrate exploded views of various components of the second stabilization assembly 180. The stabilizer plate 220 can define a plate rod opening 820 and the brace mounting bracket 620 can define a bracket rod opening 830. The threaded end portion 260 of the upper rod portion 810 of the anchor rod 190 can extend through each of the plate rod opening 820 and the bracket rod opening 830, and the first and second nuts 270*a,b* can coupled the upper rod portion 810 to the stabilizer plate 220 and the brace mounting bracket 620. The brace mounting bracket 620 can further define the bracket fastener opening 840 through which the third fastener 634 (shown in FIG. 6) can extend to couple the longitudinal brace 135 to the brace mounting bracket 620.

Figure 10:
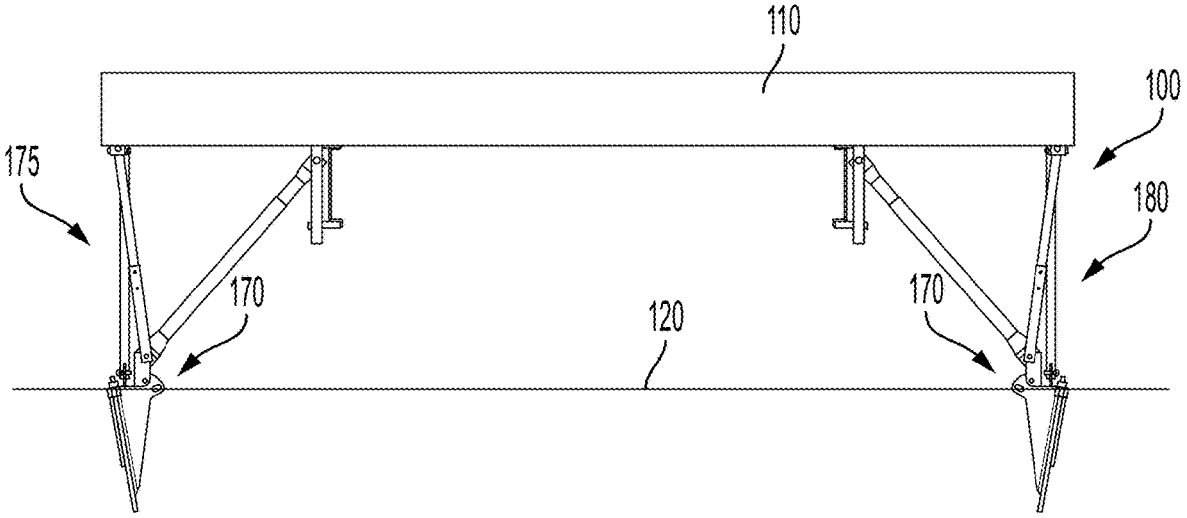
FIG. 10 is a front view of the home stabilization system according to another aspect of the present disclosure.

FIGS. 10-13 illustrate the home stabilization system 100 in accordance with another example aspect of the present disclosure. Turning now to FIG. 10, a front view of the home stabilization system 100 according to another aspect of the present disclosure is shown and described. In some aspects, the home stabilization system 100 can be used to support a structure, such as the manufactured building 105 or the manufactured home 110. It is contemplated that the home stabilization system 100 of this disclosure can be used with any structure which needs to be anchored for additional support, such as and without limitation, workshops, tiny houses, greenhouses, prefabricated houses such as cabins and mobile homes, playhouses, gazebos, modular homes, carports, shipping containers, modular homes, or the like. In some aspects, the home stabilization system 100 can displace the manufactured building or home 105,110 above the ground 120 of the residential property 115. In some aspects, the home stabilization system 100 can be configured to be anchored into the ground 120. In some aspects, the residential building or home 105,110 in combination with one or more home stabilization systems 100 can define a statically determinate system. For example, the home stabilization system 100 can comprise the first stabilization assembly 175 and the second stabilization assembly 180, the combination thereof can be configured to define a statically determinate system with the manufactured home 110. The home stabilization system 100 can comprise an anchoring portion which can include the stabilizer plate 220, the curl bracket 225, and the anchor rod 190. Each of the stabilizer plate 220, curl bracket 225, and the anchor rod 190 can be configured to form a substantially rigid subterranean mount and define a subterranean portion of the home stabilization system 100. In some aspects, the stabilization plate 220 can define a surface area of sufficient size to prevent rotation while so disposed below the ground 120. In some aspects, the subterranean portion of the home stabilization system 100 can be configured to constrain the motion thereof in at least one direction. The home stabilization system 100 can comprise the longitudinal braces 135 and the vertical brace 215 which can extend from the subterranean portion of the home stabilization system 100. In some aspects, the longitudinal braces 135 can be canted relative to the vertical brace 215. In some aspects, one or both of the longitudinal braces 135 and the vertical brace 215 can be substantially rigid and structured to support one of a tensive or compressive force generated by one the manufactured building 105. In some aspects, one or both of the longitudinal brace 135 and the vertical brace 215 can define a length and can be configured to be adjustable in length. In some aspects, the home stabilization system 100 can comprise the toggle assembly 170. The toggle assembly can be configured to selectably connect a portion of the home stabilization system 100 to the subterranean portion of the home stabilization system 100.

Figure 11:
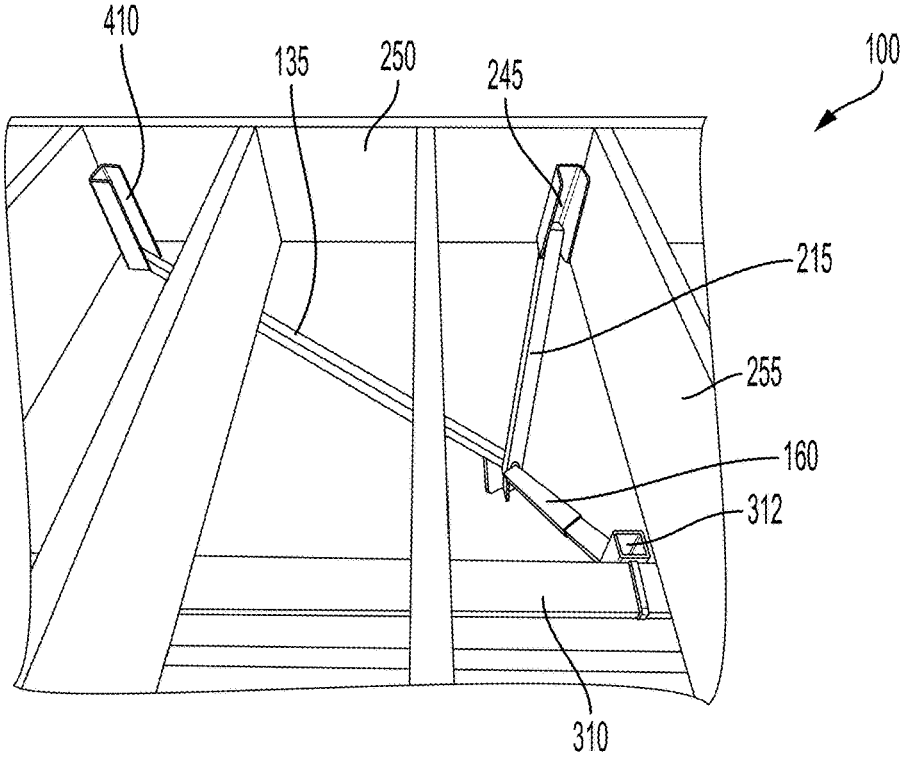
FIG. 11 is a top perspective view of the stabilization assembly of the home stabilization system of FIG. 10.

Turning now to FIG. 11, a top perspective view of the stabilization assembly (e.g., the first stabilization assembly 175 and the second stabilization assembly 180) of the home stabilization system of FIG. 10 is shown and described. In some aspects, the home stabilization system 100 can comprise the vertical brace 215, the longitudinal brace 135 and the lateral transfer strut 160. Each of the vertical brace 215, the longitudinal brace 135, and the lateral transfer strut 160 can extend upwardly from the ground 120 and can be canted relative to each other. In some aspects, the home stabilization system 100 can define a plane having an X direction, a Y direction, and a Z direction relative to the ground 120, wherein the ground 120 is the origin. Each of the vertical brace 215, the longitudinal brace 135 and the lateral transfer strut 160 can extend in the Y direction. In some aspects, the longitudinal brace 135 can define a X-Y vector component and the lateral transfer strut 160 can define a Y-Z direction component.

In some aspects, each of the vertical brace 215, the longitudinal brace 135 and the lateral transfer strut 160 can be connected to a structure, such as a manufactured home 110 or building (shown in FIG. 10). In some aspects, a portion of each of the vertical brace 215, the longitudinal brace 135, and the lateral transfer strut 160 can comprise a mounting mechanism which can be configured to securely engage with the structure. The structure, such as, for example, the manufactured home 110 (shown in FIG. 10) can comprise the rim joist 250 and the floor joist 255. The manufactured home 110 (shown in FIG. 10) can comprise a plurality of floor joists 255 disposed parallel with each other, and each of the plurality of floor joists 255 can be perpendicular to the rim joist 250. In some aspects, the intersection of the rim joist 250 and the floor joists 255 can define a corner. In some aspects, the manufactured home 110 (shown in FIG. 10) can comprise the I-beam 310. The I-beam 310 can be rigidly connected to and structured to support the manufactured home 110 (shown in FIG. 10). For example only, and without limitation, the longitudinal brace 135 can be coupled to a corner of the rim and floor joists 250,255 via the upper brace bracket 410, the vertical brace 215 can be coupled to a corner of the rim and floor joists 250,255 via the upper bracket 245, and the lateral transfer strut 160 can be coupled to the I-beam 310 via the beam brace 312.

Figure 12:
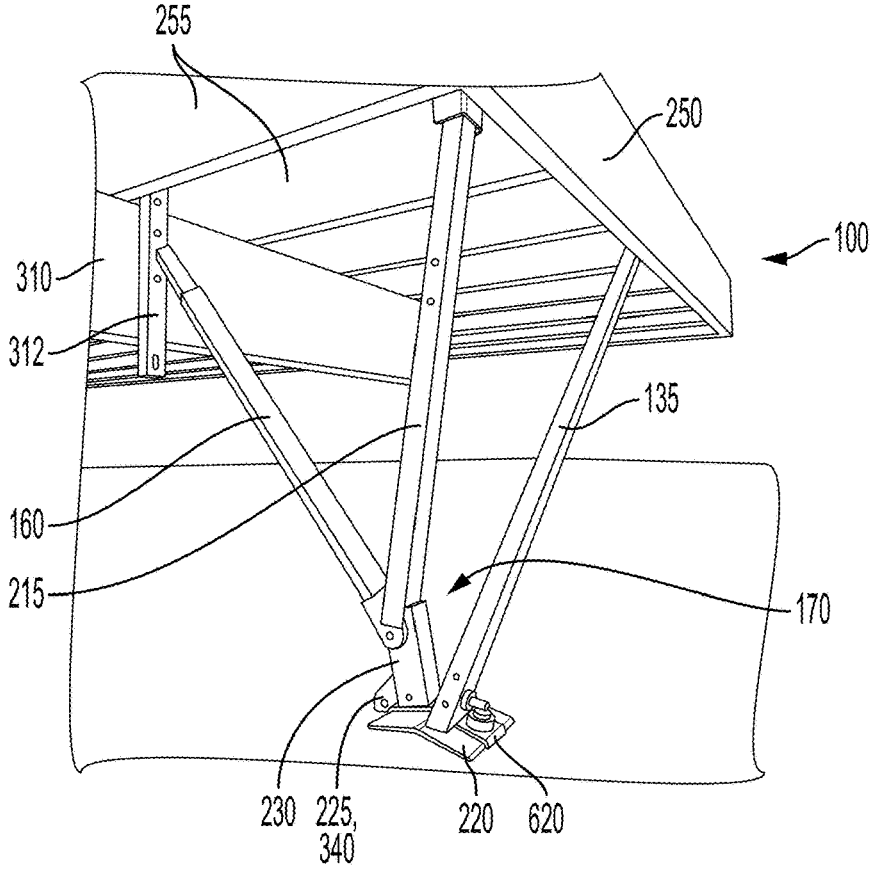
FIG. 12 is a bottom perspective view of the stabilization assembly of FIG. 11.

Turning now to FIG. 12, a bottom perspective view of the stabilization assembly of FIG. 11 is shown and described. In some aspects, the home stabilization system 100 can comprise a surface portion which can comprise the stabilizer plate 220, the lower toggle bracket 230, the curl bracket 225, and the brace mounting backet 620. In some aspects, the surface portion can be connected to the subterranean portion and be disposed at the ground 120. In some aspects, the longitudinal brace 135 can extend from the surface portion, and the lower toggle assembly 170 can extend from the surface portion, wherein the toggle assembly 170 is canted relative to the longitudinal brace 135. In some aspects, the lateral transfer strut 160 and vertical brace 215 can bifurcate from the lower toggle bracket 230 and can define an angle therebetween. In some aspects, the stabilizer plate 220 can define a bend line wherein the stabilizer plate 220 is separated into at least two portions, the at least two portions being disposed at an angle to each other. In some aspects, the stabilizer plate 220 can define a surface area of sufficient size to rigidly engage the ground 120. In some aspects, the stabilizer plate 220 can be structured to support the weight of the manufactured home 110 (shown in FIG. 10). More generally, the surface area of the stabilizer plate 220 can be sizably configured to reduce the pressure exerted on the ground sufficiently low enough to prevent the home stabilization system 100 from sinking into the ground 120. In some aspects, the toggle assembly 170 can be configured to rotate relative to the stabilizer plate 220 about the upper curl bracket portion 340. In some aspects, the toggle assembly 170 can be configured to be adjustably securable relative to the surface portion. For example only, and without limitation, the toggle assembly 170 can define a fixedly adjustable angle relative to the surface portion, and more specifically the stabilizer plate 220.

Figure 13:
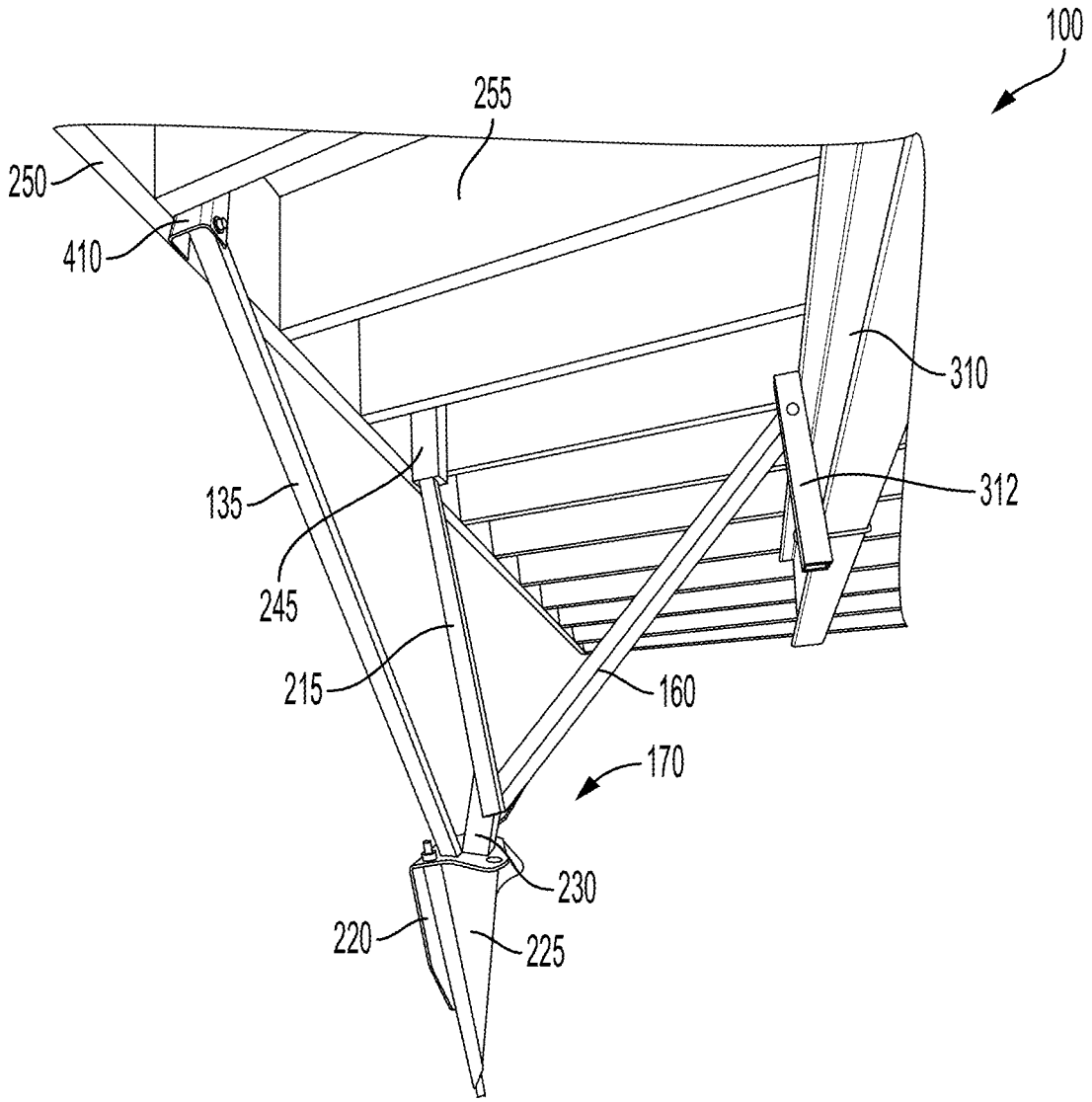
FIG. 13 is another bottom perspective view of the stabilization assembly of FIG. 11.

Turning now to FIG. 13, another bottom perspective view of the stabilization assembly of FIG. 11 is shown and described. In some aspects, the home stabilization system 100 can define the subterranean portion and the surface portion. In some aspects, the curl bracket 225 can define a body which can converge to a point, wherein the point is configured to be forced into the ground 120. In some aspects, the stabilizer plate 220 can define a body which can converge to a point configured to be forced into the ground. In many aspects, the curl bracket 225 and the stabilizer plate 220 can be disposed substantially perpendicularly to each other. In some aspects, the combination of the curl bracket 225 and the stabilizer plate 220 can be configured to substantially eliminate the motion of the subterranean portion of the home stabilizations system 100. In an exemplary operation aspect, the upper brace bracket 410 can be secured to the floor joist 255 or rim joist 250 via a fastener, such as a bolt, a screw, a nail, a lag bolt, or the like. In a further exemplary operation aspect, the upper bracket 245 can be likewise mounted to the floor joist 255 or rim joist 250 via the same. In some aspects, the upper bracket 245 and upper brace bracket 410 can be configured to be mounted to a wooden structure. In some aspects, the lateral transfer strut 160 can be affixed to the I-beam 310 via the beam brace 312. The beam brace 312 can be sizeably configured to engage with the I-beam 310 and configured to be secured thereon.

Figure 14:
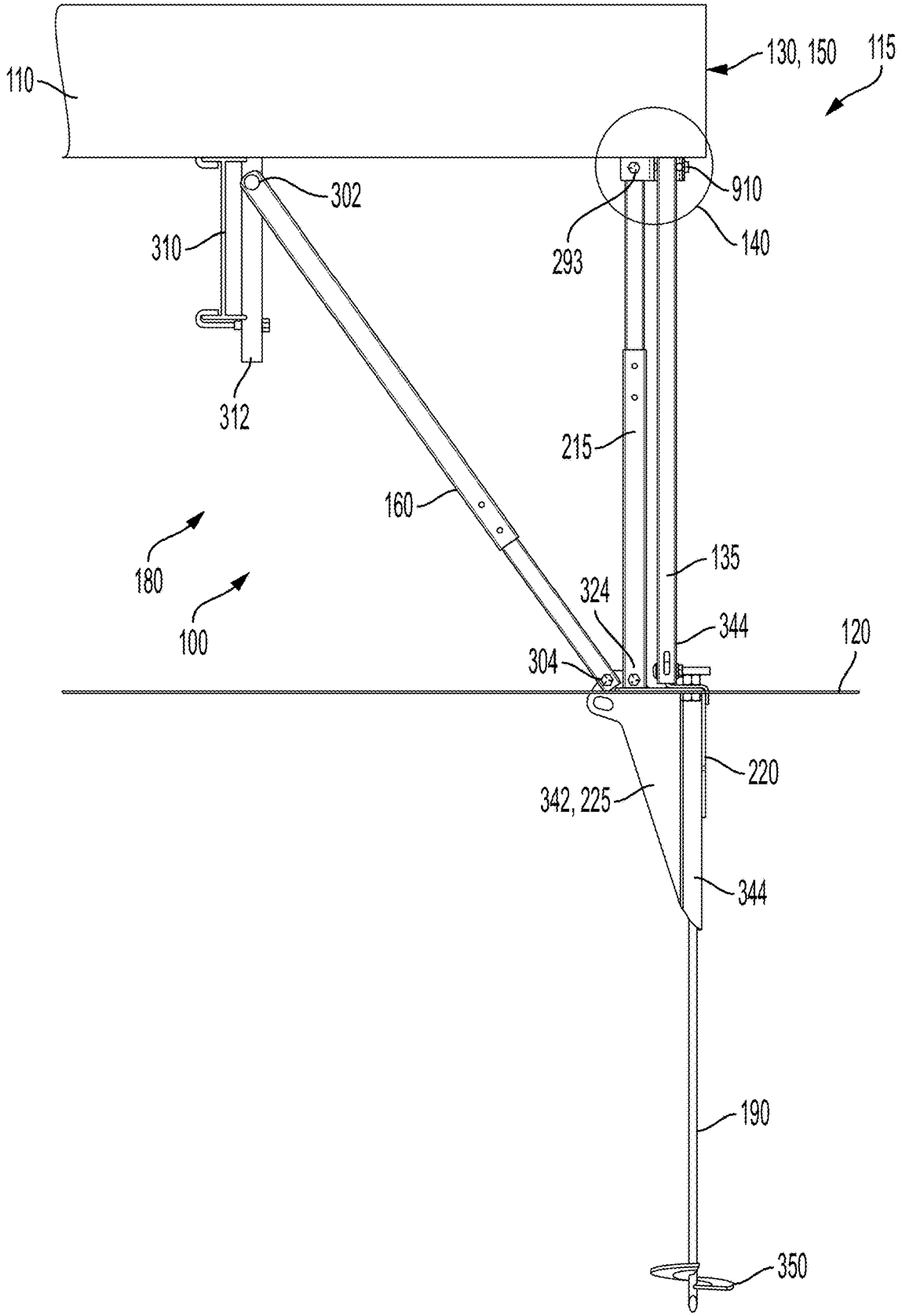
FIG. 14 is a front view of the stabilization assembly of the home stabilization system, according to another aspect of the present disclosure.

Turning now to FIG. 14, a front view of the stabilization assembly 180 of the home stabilization system 100, according to another aspect of the present disclosure, is shown and described. In some aspects, the home stabilization system 100 of the present disclosure can be configured to increase the stability of the manufactured building 110. In some aspects, the home stabilization system 100 can be configured to be installed on a manufactured building 105 disposed on the residential property 115. In some aspects, the manufactured building 105 can define the leeward side 130 as the lateral side 150 which defines the home stabilization system 100. In some aspects, the home stabilization system 100 can comprise the lateral transfer strut 160. The lateral transfer strut 160 can be configured to extend between the manufactured home 110 and the stabilizer plate 220. More specifically, the lateral transfer strut 160 can extend from a surface of the stabilizer plate 220. In some aspects, the surface of the stabilizer plate 220 can be configured to be at the ground 120. In some aspects, the home stabilization system 100 can comprise the vertical brace 215. The vertical brace 215 can be configured to extend from the stabilizer plate 220 upwardly towards the manufactured building 110. In some aspects, the vertical brace 215 and the lateral transfer strut 160 can be coupled with the stabilizer plate 220. More specifically, the second transfer strut end 304 and the second vertical brace end 324 can be proximally coupled with the surface of the stabilizer plate 220. In some aspects, the second transfer strut end 304 and the second vertical brace end 324 can be directly coupled to the stabilizer plate 220 or any portion thereof. In some aspects, the second transfer strut end 304 and the second vertical brace end 324 can be canted relative to each other.

In some aspects, the home stabilization system 100 can comprise the longitudinal brace 135. The longitudinal brace 135 can be configured to extend from the stabilizer plate 220. The longitudinal brace 135 can be configured to directly coupled to the stabilizer plate 220. In some aspects, each of the longitudinal brace 135, the vertical brace 215, and the lateral transfer strut 160 can be coupled with both the stabilizer plate 220 and the manufactured building 110, and can be configured to substantially eliminate relative motion therebetween. More generally, the home stabilization system 100 can be configured to transfer loading experienced by the manufactured building 105, such as loads caused by winds, to the ground 120. In some aspects, the home stabilization system 100 can be configured to define the statically determinate system including the ground 120 and the manufactured building 110. In some aspects, the home stabilization system 100 can be configured to provide a tensive force to the manufactured building 110. In other aspects, the home stabilization system 110 can be configured to provide a compressive force.

In some aspects, the home stabilization system 100 can comprise the anchor rod 190. The anchor rod 190 can initiate at the stabilization plate 220 and can extend downwardly. In some aspects, the anchor rod 190 can extend through or partially through a rod sleeve 344. In some aspects, the anchor rod 190 can be configured to rotate and/or translate within the rod sleeve 344, The anchor rod 190 can terminate distal to the stabilization plate 220 and can define the anchor helix 350. The anchor helix 350 can be configured to engage with the ground. More specifically, the anchor helix 350 can be an auger configured to, when urged by the anchor rod 190 to rotate, burrow into the ground 120. In some aspects, the anchor helix 350 of the anchor rod 190 can be a screw. In an exemplary aspect, and without limitation, the anchor rod 190 can be rotated by a user, and while so rotated, can urge the anchor helix 350 to rotate. The anchor helix 350 can burrow into the ground 120 and provide a tensile force to the anchor rod 190. In some aspects, the anchor rod can be configured to constrain the home stabilization system 100. More specifically, the anchor rod 190 can be configured to constrain the stabilizer plate 220 and/or the curl bracket 225. In some aspects, the anchor rod 190 can be installed by a machine, such as a installation device (not shown). In some aspects, the anchor rod 190 can be configured to be rotated by a power tool (not shown) such as a cordless drill or impact driver. In another exemplary aspect, the anchor rod 190 can be configured to pull the stabilizer plate 220 towards the ground 120.

In some aspects, the home stabilization system 100 can be engaged with the manufactured building 110. More specifically, the first transfer strut end 302 can be coupled with the I-beam 310 via the beam brace 312. The vertical brace 215 can be coupled to the manufactured building 105 via the upper bracket 245. The upper brace bracket 410 can be coupled to the manufactured building 105 via the upper brace bracket 410. In some aspects, the combination of the upper brace bracket 410, the manufactured building 110, and the longitudinal brace 135 can define the interface 140.

Figure 15:
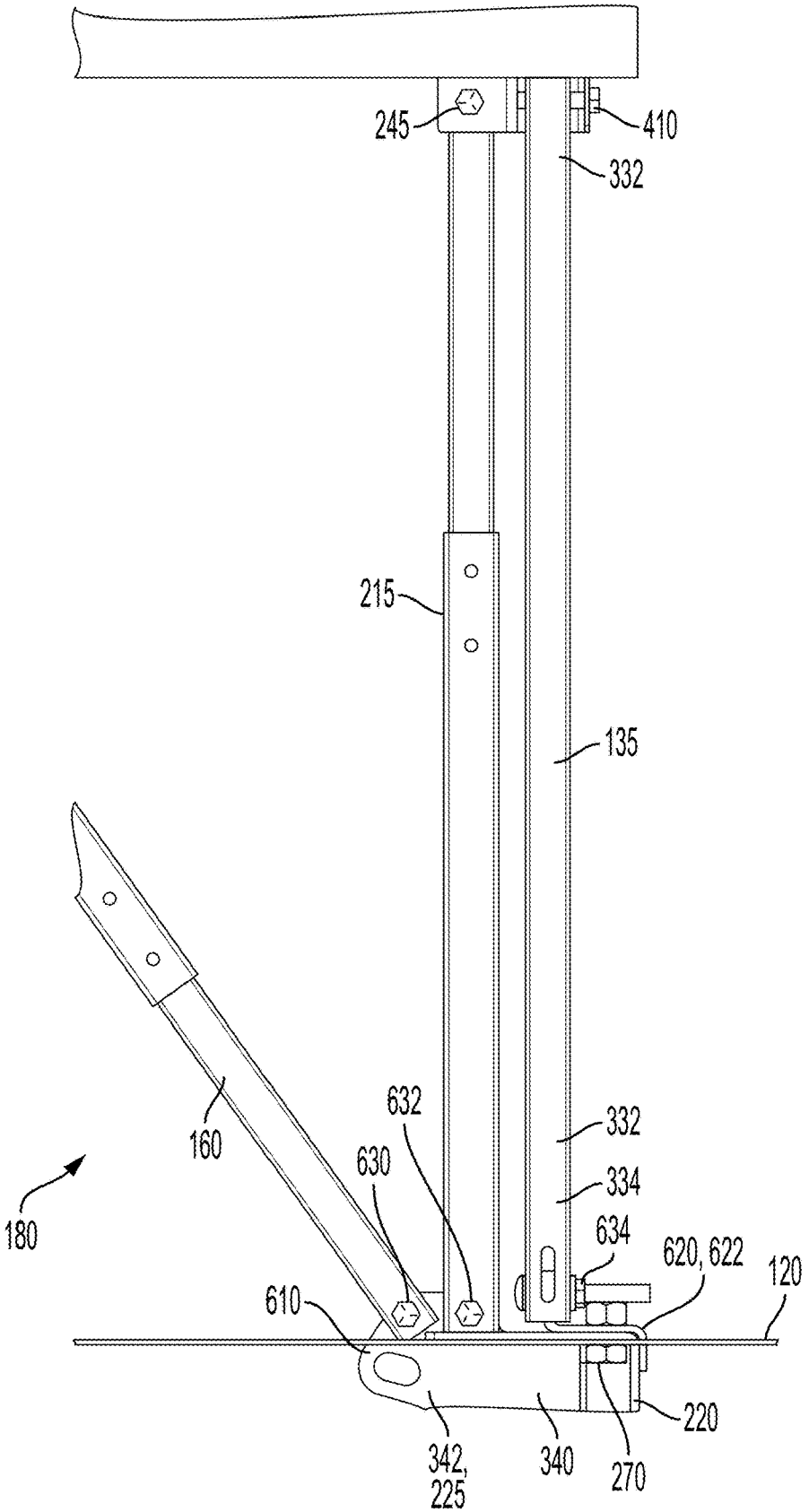
FIG. 15 is a detail front view of the stabilization assembly of FIG. 14.

Turning now to FIG. 15, a detail front view of the stabilization assembly 100 of FIG. 14 is shown and described. In some aspects, the home stabilization system 100 can comprise the first stabilization assembly 175 and the second stabilization assembly 180. In some aspects, the combination of the first stabilization assembly 175 and the second stabilization assembly 180 can be configured to secure a structure. For example and without limitation, the first stabilization assembly 175 can be configured to divert a load, such as, for example, a wind load applied on a structure in a first vector, and the second stabilization assembly 180 can be configured to balance the load in the first vector with a load from a second vector opposite the first vector. More generally, the first stabilization assembly 175 and the second stabilization assembly 180 can be configured to support a structure by vectoring the perceived load of the structure against or partially against itself. In some aspects, the home stabilization system 100 can comprise the lateral transfer strut 160 and the vertical brace 215. Each of the lateral transfer strut 160 and the vertical brace 215 can be coupled to the stabilizer plate 220. In some aspects, the lateral transfer strut 160 and the vertical brace 215 can be directly coupled to a portion of the stabilizer plate 220. In some aspects the stabilizer plate 220 can be comprise the tab portion 610. The tab portion 610 can be disposed substantially perpendicular to the stabilizer plate 220. In some aspects, the tab portion 610 can be configured to engage the lateral transfer strut 160 and/or the vertical brace 215. In some aspects, the tab portion can define a mounting locus which can comprise the lateral transfer strut 160 and the vertical brace 215. In some aspects, the lateral transfer strut 160 and the vertical brace 215 can be secured to the tab portion 610 of the curl bracket 225 via a fastener. The fastener can be any fastener, such as a bolt, a rivet, a screw, a pin, or the like. In some aspects, the lateral transfer strut 160 and the vertical brace 215 can be coupled to the tab portion 610 of the curl bracket 225 via a first fastener 630 and a second fastener 632.

In some aspects, the longitudinal brace 135 can be coupled to the stabilization plate 220 via the brace mounting bracket 620. The brace mounting bracket 620 can be connected to the stabilization plate 220 via the brace mounting weldment 622. In some aspects, the longitudinal brace 135 can be coupled to the brace mounting bracket 620 via a third fastener 634. In some aspects, each of the lateral transfer strut 160, the vertical brace 215, can be rigidly mounted to the curl bracket 225.

Figure 16:
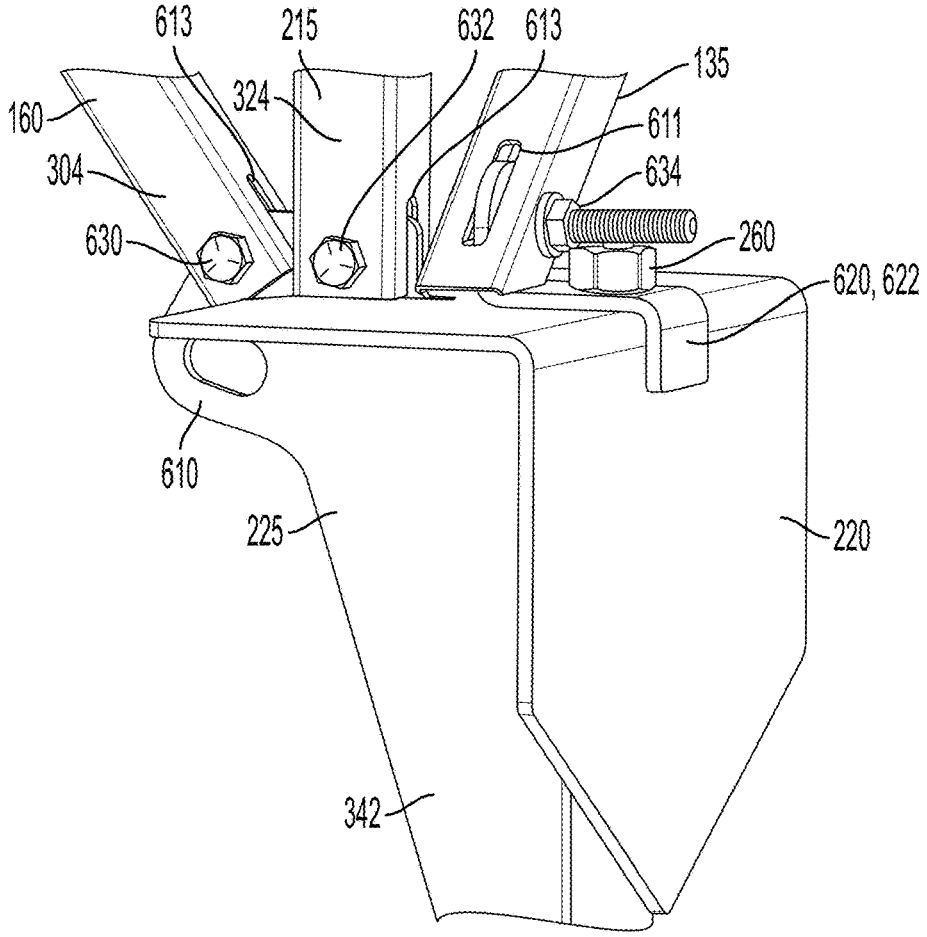
FIG. 16 is a detail front perspective view of the stabilization assembly of FIG. 14.

Turning now to FIG. 16, a detail front perspective view of the stabilization assembly 180 of FIG. 14 is shown and described. In some aspects, the stabilization plate 220 can define a first section and a second section, wherein the first section and section are disposed substantially perpendicularly to each other and wherein the first section is configured to engage the ground 120 and the second section is configured to be driven into the ground 120. In some aspects, the stabilization plate 220 can be configured to intersect the curl bracket 225. More specifically, the stabilization plate 220 can define a slit in a portion thereof configured to receive the tab portion 610 of the curl bracket 225. In some aspects, the brace mounting bracket 620 can be configured to engage the stabilization plate 220. The brace mounting bracket 620 can be fastened to the stabilization plate 220 via the threaded hex nut 270, and more specifically the second nut **270*b*. The threaded hex nut 270 can be configured to engage the threaded portion 260 of the anchor rod 190. In some aspects each of the lateral transfer strut 160 and the vertical brace 215 can comprise an mating feature. More specifically, the lateral transfer strut 160 and the vertical brace 215 can each comprise an end slot 613 disposed at an end thereof. In some aspects, the end slot 613 of each of the lateral transfer strut 160 and the vertical brace 215 can be configured to engage the curl bracket 625, and more specifically, the tab portion 610 of the curl bracket 225. In some aspects, the lateral transfer strut 160 and the vertical brace 215 can engage the tab portion 610 by each forming a loose tongue and groove joint therewith. In some aspects, each of the lateral transfer strut 160 and the vertical brace 215 can define a fastener hole at an end thereof configured to receive a fastener, such as the first or second fastener 630,632. In some aspects, the longitudinal brace 135 can comprise a mounting feature disposed at an end thereof. For example, the longitudinal brace 135 can comprise a slot 611 defined proximate to an end thereof, and the slot 611 can be configured to receive the brace mounting bracket 620 or a portion thereof. In an exemplary aspect, the brace mounting bracket 620 can extend through a slot 611 defined in the longitudinal brace 135 and can be configured to articulate around the slot 611**.

Figure 17:
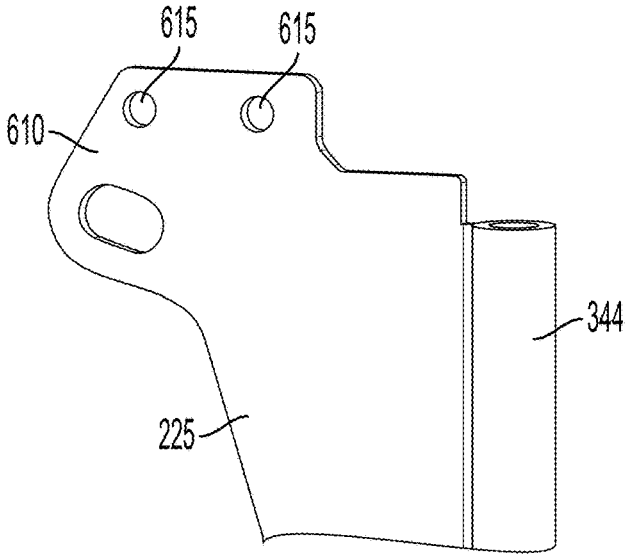
FIG. 17 is a detail front perspective view of a curl bracket of FIG. 14 is in accordance with an aspect of the present disclosure.

Turning now to FIG. 17, a detail front perspective view of a curl bracket 225 of FIG. 14 is shown and described. In some aspects, the home stabilization system 100 can comprise the curl bracket 225. The curl bracket 225 can define a substantially planar member which can comprise a plurality of holes, the tab portion 610, and the rod sleeve 344. The curl bracket 225 can define one or more bracket mount holes 615. The bracket mount holes 615 can be defined on the body of the curl bracket 225, for example at the tab portion 610. The bracket mount holes 615 can be configured to receive a fastener, such as bolt. In some aspects, the bracket mount holes 615 can be configured to receive one of the first fastener 630 or the second fastener 632 and can define a mounting locus for either of the lateral transfer strut 160 or the vertical brace 215. In some aspects, as shown in FIG. 16, the first fastener 630 can extend through one of the bracket mount holes 615 and a transfer strut opening proximate to the second transfer strut end 304 of the lateral transfer strut 160, and the second fastener can extend through another of the bracket mount holes 615 and a vertical brace opening proximate to the second vertical brace end 324 of the vertical brace 215. In some aspects, the transfer strut opening and the vertical brace opening can each be defined as a pair of aligned holes extending through each side of the tubes forming the lateral transfer strut 160 and the vertical brace 215. The curl bracket 225 can define the rod sleeve 344 disposed at an end thereof. The rod sleeve 344 can be a substantially cylindrical member defining a hollow interior. The rod sleeve 344 can extend downwardly towards the ground 120 (shown in FIG. 14). The rod sleeve 344 can be configured to engage with the anchor rod 190 (shown in FIG. 14). In some aspects, the rod sleeve 344 can be configured to enable the anchor rod 190 (shown in FIG. 14) to rotate therein. The rod sleeve 344 can be attached to the curl bracket 225 by, for example, welding. In other aspects, the rod sleeve 344 can be monolithic with the curl bracket 225.

Figure 18:
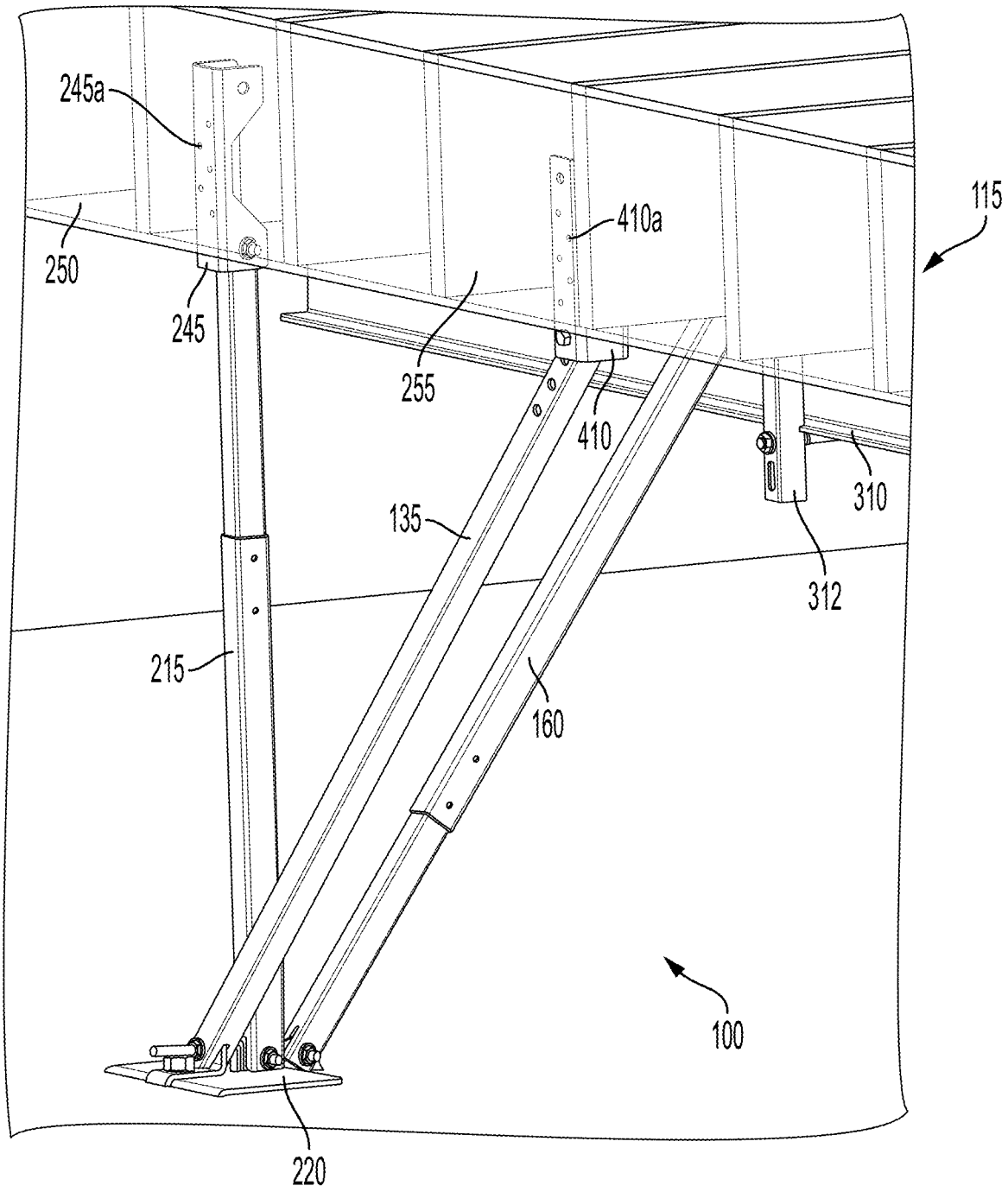
FIG. 18 is a detail right-side perspective view of the stabilization assembly of FIG. 14.

Turning now to FIG. 18, a detail right-side perspective view of the stabilization assembly 180 of FIG. 14 is shown and described. In some aspects, the home stabilization system 100 can be coupled to one or both of the rim joist 250 or the floor joist 255 of a structure. The lateral transfer strut 160 can be coupled to the structure via the upper bracket 245 and the vertical brace 215 can be coupled to the structure via the upper brace bracket 410. In an exemplary aspect, the lateral transfer strut 160 can be coupled to the rim joist 250 via the upper bracket 245 and the vertical brace 215 can be coupled to the floor joist 255 via the upper brace bracket 410. In some aspects, the upper bracket 245 can be coupled to a planar surface of the rim joist 250 or the floor joist 255. In some aspects, the upper bracket 245 can be coupled to a corner formed by the intersection of the rim joist 250 and the floor joist 255. In some aspects, the upper brace bracket 410 can be coupled to a planar surface of the rim joist 250 or the floor joist 255. In some aspects, the upper brace bracket 410 can be coupled to a corner formed by the intersection of the rim joist 250 and the floor joist 255. In an exemplary aspect, the upper bracket 245 can be coupled to the planar surface of the rim joist 250 and the upper brace bracket 410 can be coupled to the corner of the rim joist 250 and the floor joist 255.

One or both of the upper bracket 245 and upper brace bracket 410 can be coupled to the structure by a fastening mechanism. Examples of such fastening mechanisms can comprise but are not limited to wood screws, machine screws, lag screws, bolts, carriage bolts, dowels, rivets, threaded inserts, self-tapping screws, and anchors. One or both of the upper bracket 245 and upper brace bracket 410 can comprise a mounting face. The mounting face can be substantially planar and can define thereon one or more holes. For example, the upper bracket 245 can comprise one or more upper bracket holes 245*a* and the upper brace bracket 410 can comprise one or more upper brace bracket holes 410*a*. The upper bracket holes 245*a* and the upper brace bracket holes 410*a* can be configured to receive the fasteners. The upper bracket holes 245*a* and the upper brace bracket holes 410*a* can be configured to extend through the body of the upper bracket 245 and the upper brace bracket 410 respectively.

Figure 19:
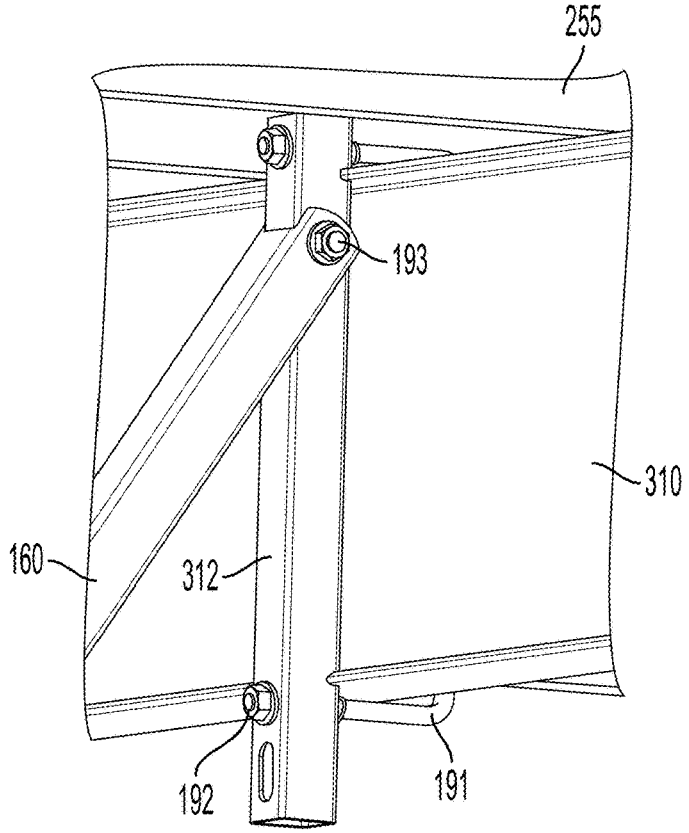
FIG. 19 is a detail right-side perspective view of the stabilization assembly of FIG. 14.

Turning now to FIG. 19, a detail right-side perspective view of the stabilization assembly 180 of FIG. 14 is shown and described. In some aspects, any portion of the home stabilization system 100 can be configured to be coupled with the beam brace 312. In an example aspect, the lateral transfer strut 160 can be coupled to the beam brace 312. The beam brace 312 can be configured to be coupled with the I-beam 310. The I-beam can be configured to be coupled with the structure, such as the manufactured building 105 or manufactured home 110. The I-beam 310 can be a load bearing member and can be part of a load bearing structure of the manufactured building 105 or manufactured home 110. In example aspects, the lateral transfer strut 160 can be configured to engage with the beam brace 312 at a beam brace joint 193. The beam brace joint 193 can be securably engage with an end of the lateral transfer strut 160. In some aspects, the lateral transfer strut 160 can define a dado portion which can be configured to engage the beam brace 312. The lateral transfer strut 160 can be fastened to the beam brace 312 via a fastener, such as a bolt. In many aspects, the beam brace 312 can be configured to transfer a load from the structure, such as a manufactured building 105 to the lateral transfer strut 160. The beam brace 312 can be configured to be releasably secured to the I-beam 310. In some aspects, the beam brace 312 can be clamped to the I-beam 310. In some aspects, the beam brace 312 can define a first end and a second end, wherein each of the first end and the second end of the beam brace 312 can comprise a clamping mechanism. The clamping mechanism can comprise a mechanism configured to clamp the beam brace 312 to the I-beam 310. In some aspects, the clamping mechanism can be a J-hook 191. The J-hook 191 can be threadedly secured to the beam brace 312 by a J-hook fastener 192. The J-hook fastener 192 can be a threaded fastener, such as a nut. The J-hook 191 can comprise a threaded section which can threadedly engage with the J-hook fastener 192.

Figure 20:
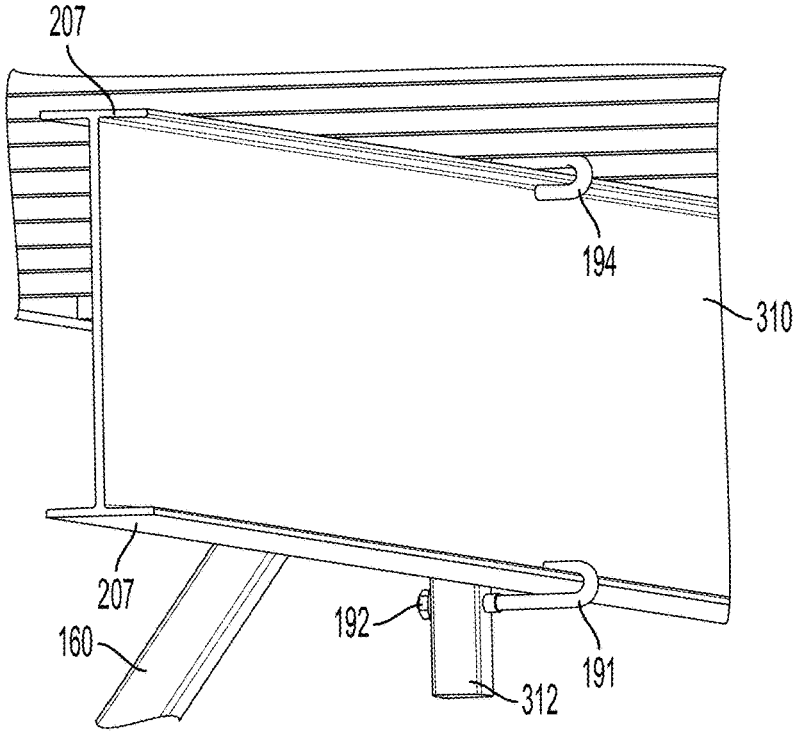
FIG. 20 is a detail left-side perspective view of the stabilization assembly of FIG. 14.

Turning now to FIG. 20, a detail left-side perspective view of the stabilization assembly 180 of FIG. 14 is shown and described. In some aspects, the J-hook 191 can comprise a hook 194. The hook 194 can be defined opposite to the threaded portion of the J-hook 191. The hook 194 can be configured to clamp to the I-beam 310. For example only, and without limitation, the hook portion 194 of the J-hook 191 can be configured to engage with a flange 207 of the I-beam. In some aspects, the I-beam can define a pair of flanges 207 spaced apart by a web. The beam brace 312 can comprise the pair of J-hooks 191 each defining the hook 194 configured to engage with the pair of flanges 207. In many aspects, the combination of the J-hooks 191 and the beam brace 312 can substantially rigidly secure the lateral transfer strut 160 to the I-beam 310.

Figure 21:
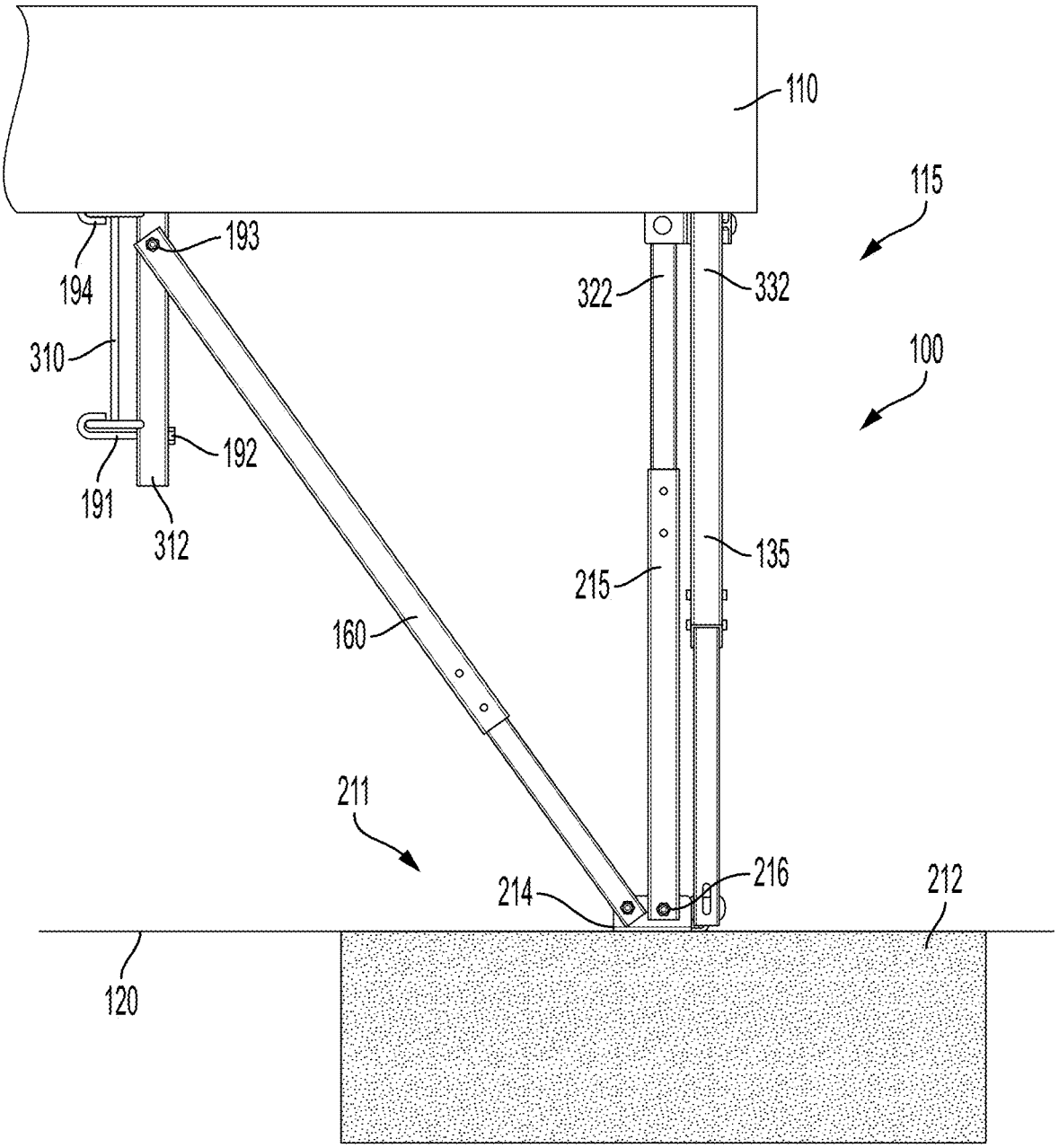
FIG. 21 is a front view of the stabilization assembly of the home stabilization system, according to another aspect of the present disclosure.

Turning now to FIG. 21, a front view of the stabilization assembly 180 of the home stabilization system, according to another aspect of the present disclosure, is shown and described. In many aspects, the home stabilization system 100 can be configured to manipulate the force balance that the manufactured home 110 may experience. For example, the home stabilization system 100 can be configured to modulate the force that the manufactured home 110 is subject to during a wind event. For example, the home stabilization system 100 can be configured to transfer loading generated during the wind event by stabilizing the manufactured home or building 110,105 to two or more sides thereof. The home stabilization system 100 can be used to oppose the experienced load by generating a reactionary force on an opposite side to the experienced load. In one aspect, the home stabilization system 100 can comprise a manufactured building 105 comprising the first stabilization assembly 175 (shown in FIG. 1) and the second stabilization assembly 180 (shown in FIG. 1) opposite the first stabilization assembly 175 (shown in FIG. 1). In many aspects, the home stabilization system 100 can be configured to generate reactionary forces which can react to loads experiences by the manufactured building or home 105,110 by way of the opposing first stabilization assembly 175 and second stabilization assembly 180 (shown in FIG. 1)

The base assembly 218 of the home stabilization system 100 can comprise an anchor assembly 211. The anchor assembly 211 can be disposed at an end of the home stabilization system 100 opposite to the manufactured building 105. In some aspects, as shown, the anchor assembly 211 can be below the ground 120 or otherwise subterranean. In some aspects, a first portion of the anchor assembly 211 can be below the ground 120 while a second portion of the anchor assembly 211 can be above the ground 120, and in other aspects, the anchor assembly 211 can be entirely above ground 120. In some aspects, the anchor assembly 211 can comprise an anchor 212. The anchor 212 can be configured to be below the ground 120 and can be configured to be rigidly buried below the ground 120. In some aspects, the anchor 212 can be several fect below the ground 120. In some aspects, the anchor 212 can be placed in an excavated hole in the ground 120. In some aspects, the anchor 212 can define a mass and volume sufficient to remain buried in the ground 120 and remain motionless therein. The anchor 212 can be, for example and without limitation, a concrete block, a metallic block, or any mass of suitable size and mass to anchor the anchor assembly 211. The anchor 212 can be any device configured to hold the anchor assembly 211 and more generally, the home stabilization system 100 in place. In some aspects, the anchor 212 is substantially rectilinear, although other shapes are contemplated.

The anchor 212 can be coupled to an anchor bracket 214. The anchor bracket 214 can be configured to secure the anchor 212 to the home stabilization system 100. More specifically, the anchor bracket 214 can be configured to couple the anchor 212 to any of the lateral transfer strut 160, the vertical brace 215, and the longitudinal brace 135. The anchor bracket 214 can be configured to transfer a load from the manufactured building 105 to the anchor 212. In some aspects, the anchor bracket 214 can be disposed at the surface of the ground 120. The anchor bracket 214 can be configured to retain the home stabilization system 100 against the ground 120. In some aspects, the home stabilization system 100 can connected to the anchor bracket 214 with an anchor bracket fastener 216. The anchor bracket fastener 216 can be a mechanical fastener, such as a bolt, rivet, dowel, pin, or any suitable fastening mechanism.

Figure 22:
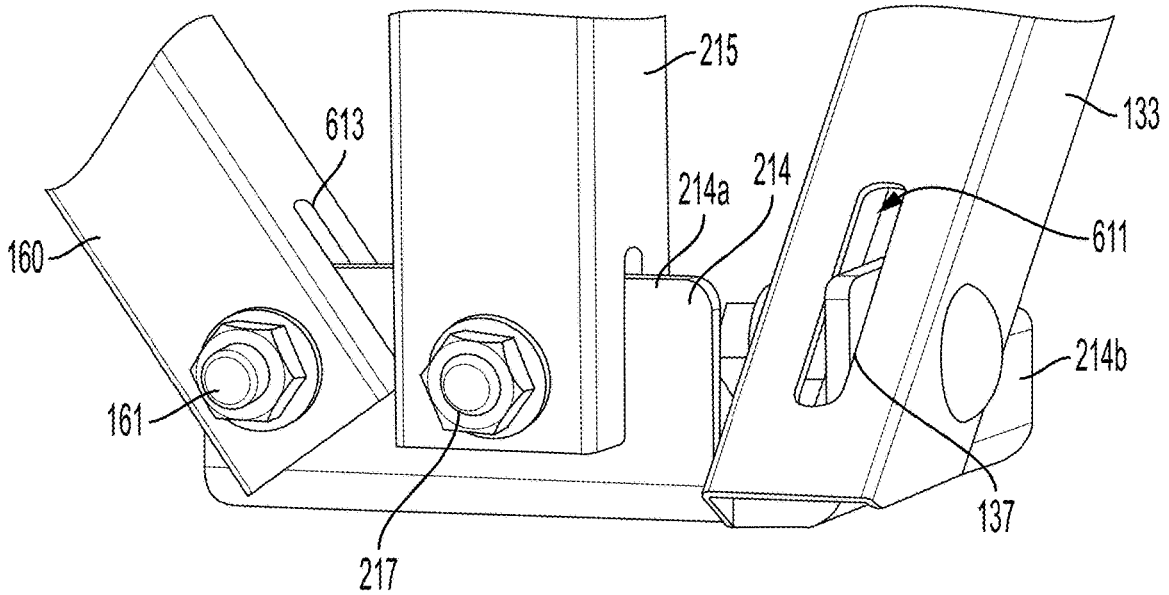
FIG. 22 is a detail front perspective view of the stabilization assembly of FIG. 21.

Turning now to FIG. 22, a detail front perspective view of the stabilization assembly 180 of FIG. 21 is shown and described. In some aspects, the anchor bracket 214 can define a first anchor bracket tab 214*a* and a second anchor bracket tab 214*b*. The first anchor bracket tab 214*a* and second anchor bracket tab 214*b* can be defined about a perimeter of the anchor bracket 214. In some aspects, the first anchor bracket tab 214*a* can be disposed substantially perpendicularly to the second anchor bracket tab 214*b*. In an exemplary arrangement, the first anchor bracket tab 214*a* can be coupled with the lateral transfer strut 160 and the vertical brace 215 and the second anchor bracket tab 214*b* can be coupled with the longitudinal brace 135. In some aspects, the lateral transfer strut 160 can comprise the end slot 613, wherein the end slot 613 can be configured to engage with the first anchor bracket tab 214*a*. In some aspects, the vertical brace 215 can comprise the slot 611 disposed at one end thereof. The vertical brace 215 can be connected to the second anchor bracket tab 214*b* via the slot 611.

Figure 23:
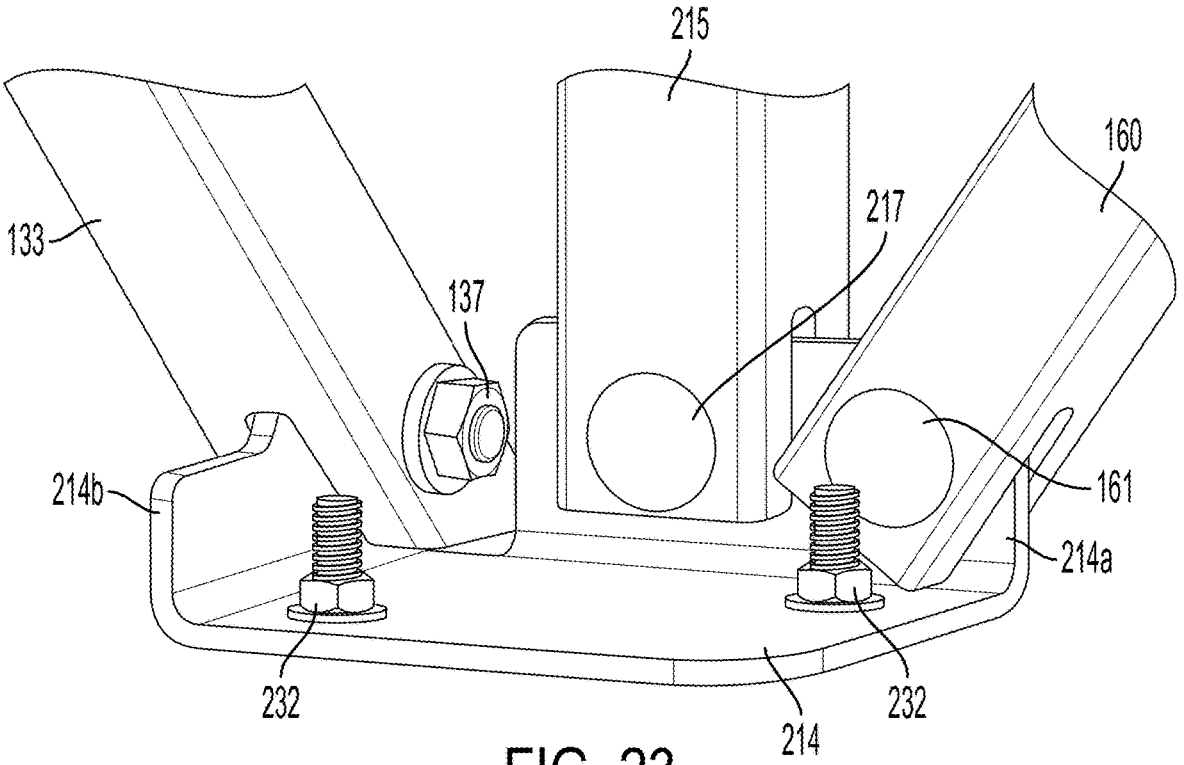
FIG. 23 is a detail rear perspective view of the stabilization assembly of FIG. 21.

Turning now to FIG. 23, a detail rear perspective view of the stabilization assembly 180 of FIG. 21 is shown and described. In some aspects, the longitudinal brace 135 can be connected to the secondary anchor bracket tab 214*b* via a longitudinal anchor fastener 137. The longitudinal anchor fastener 137 can be a threaded fastener which can extend through the longitudinal brace 135 and secondary anchor bracket tube 214*b*. In some aspects, the vertical brace 215 can be connected to the first anchor bracket tab 214*a* via a longitudinal toggle anchor fastener 217. The longitudinal toggle anchor fastener 217 can be a threaded fastener which can extend through the vertical brace 215 and the secondary anchor bracket tab 214*b*. In some aspects, the lateral transfer strut 160 can be connected to the primary anchor tab 214*a* via a lateral anchor fastener 161. The lateral anchor fastener 161 can be configured to extend through the lateral transfer strut 160 and the secondary anchor tab 214*a*. Each of the longitudinal anchor fastener 137, the longitudinal toggle anchor fastener 217, and the lateral anchor fastener 161 can comprise a fastening mechanism such as a bolt, a carriage bolt, a rivet, a weldment, a screw, a machine screw, a pinion, or any suitable fastening mechanism.

Figure 24:
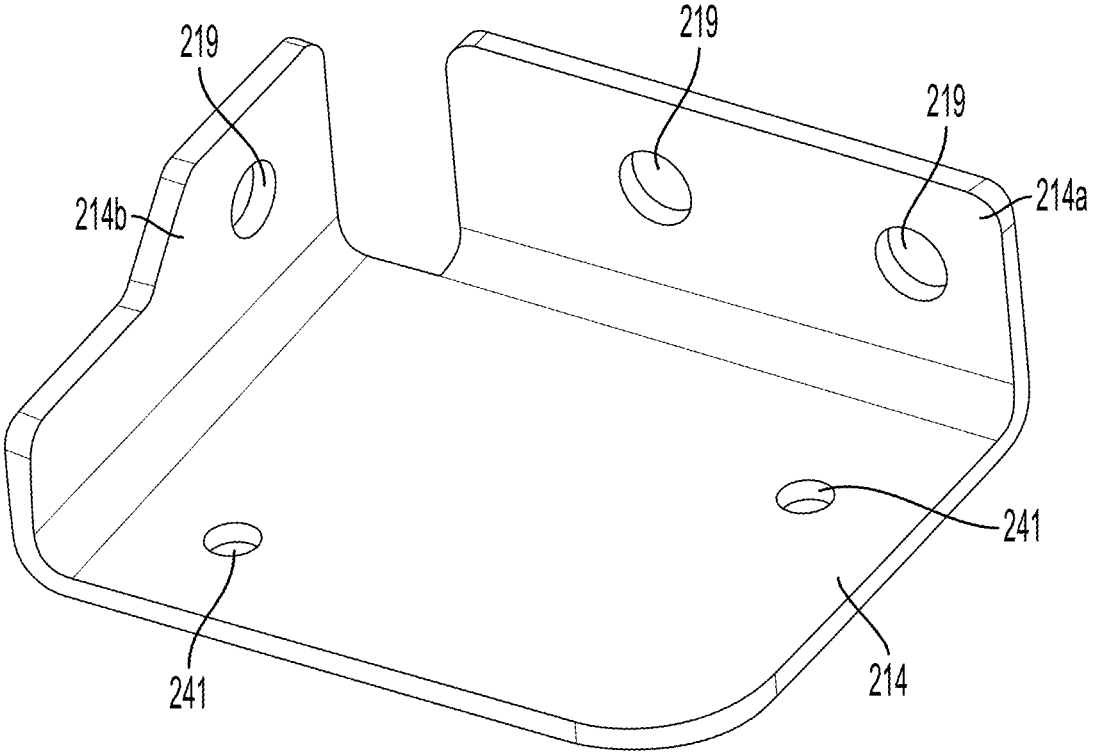
FIG. 24 is a perspective view of a concrete anchor bracket of the stabilization assembly of FIG. 21.

Turning now to FIG. 24, a perspective view of a concrete anchor bracket 214 of the stabilization assembly of FIG. 21 is shown and described. The anchor bracket 214 can define a substantially planar surface. In some aspects, the anchor bracket 214 can be substantially rectilinear, although other shapes are contemplated. In some aspects, the anchor bracket 214 can comprise an anchor fastener hole 241. The anchor fastener hole 241 can be a through hole which can extend through the anchor bracket 214. In some aspects, the anchor fastener hole 241 can be configured to accept an anchor bolt (not shown). The anchor bolt (not shown) can be configured to secure the anchor 212 (shown in FIG. 21) to the anchor assembly 211. In exemplary aspects, the anchor bracket 214 can comprise a plurality of anchor fastener holes 241. The anchor bracket 214 can define the perimeter, and the first anchor bracket tab 214*a* and the second anchor bracket tab 214*b* can be disposed around the perimeter. In many aspects, the first anchor bracket tab 214*a* and second anchor bracket tab 214*b* can be perpendicular to each other. In some aspects, the first anchor bracket tab 214*a* can comprise at least one anchor tab hole 219. The anchor tab holes 219 can be configured to receive a fastener. In some aspects, the anchor tab hole 219 can be a through hole. In some aspects, the second anchor bracket tab 214*b* can comprise the anchor tab hole 219. More generally, the anchor bracket 214 can comprise a plurality of anchor tab holes 219 which can be configured to secure the anchor bracket to the home stabilization assembly.

A method of using the home stabilization system 100 of the present disclosure or any portion thereof can comprise providing the home stabilization system 100 or any portion thereof as described herein. The method can comprise installing the home stabilization system 100 to a structure. The structure can be any structure which can be externally stabilized. In some aspects, method can comprise installing the home stabilization system 100 on a manufactured building 105 or manufactured home 110. The method can comprise stabilizing a structure with the home stabilization system 100. In some methods, the structure can be stabilized with the first stabilization assembly 175 and the second stabilization assembly 180 wherein the first stabilization assembly 175 is disposed on an opposite side of the structure to the second stabilization assembly 180. In some aspects, the method can comprise providing a reaction force to a loading force. In some aspects, the reaction force can be substantially similar in magnitude to the loading force. The loading force can be generated by a wind event, an earthquake event, or any similar act of God. In some aspects, a method of stabilizing a structure is disclosed. In some aspects, the method can comprise anchoring a structure to the ground 120. For example and without limitation, the method can comprise providing an anchor rod 190. The anchor rod 190 can be configured to anchor the home stabilization system 100 to the ground 120. In some aspects, the method can comprise anchoring the home stabilization system 100 with an anchor 212. The anchor 212 or anchor rod 190 can be drilled, buried, excavated, or disposed in the ground by any applicable means. The method can comprise connecting the home stabilization system 100 to the anchor assembly.

In some aspects, a method of installing the home stabilization system 100 is disclosed. The method can comprise the steps of providing the home stabilization system 100. In some aspects, the method can comprise the steps of burying the anchor 212 below the ground 120. In some aspects, the method can comprise the steps of burying the anchor rod 190 below the ground 120. In some aspects, the method can comprise the step of utilizing a power tool to bury any of the home stabilization system 100 below the ground 120. In some aspects, the method can comprise providing a device (not shown) configured to bury a portion of the home stabilization system 100 below the ground 120. In some methods, the structure can be winched towards the home stabilization system 100. More specifically, the home stabilization system 100 can comprise a winching mechanism (not shown) which can be configured to urge the structure towards the home stabilization system 100. In some aspects, the winch (not shown) can be a ratchet strap. In some aspects, the winch can be a come-along. In some aspects, the winch can be any mechanical device configured to provide a pulling force between two objects. In some methods, the home stabilization system 100 can be connected to the structure while the winch is connected. In some methods, the winch can be released after the structure is connected to the home stabilization system 100.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A home stabilization system comprising:

a base assembly configured to be mounted to a ground;

a lateral transfer strut configured to be pivotably coupled to a manufactured home at a first transfer strut end and pivotably coupled to the base assembly at an opposite second transfer strut end;

a vertical brace configured to be pivotably coupled to the manufactured home at a first vertical brace end and pivotably coupled to the base assembly at an opposite second vertical brace end; and an anchor rod coupled to the base assembly and configured to extend downward from the base assembly into the ground, wherein:

the base assembly defines a rod sleeve;

the anchor rod defines an upper rod portion extending through the rod sleeve and a lower rod end distal to the upper rod portion;

an anchor helix is coupled to the anchor rod proximate to the lower rod end;

the upper rod portion of the anchor rod defines a threaded end portion extending through a plate rod opening of the base assembly; and a threaded nut is tightened on to the threaded end portion of the anchor rod to couple the anchor rod to the base assembly.

2. The home stabilization system of claim 1, further comprising a longitudinal brace configured to be coupled to the manufactured home at a first longitudinal brace end and coupled to the base assembly at a second longitudinal brace end.

3. The home stabilization system of claim 2, wherein each of the lateral transfer strut and the longitudinal brace are configured to be arranged at about 45° relative to the ground and are configured to pivot within a range of angles above and below 45°.

4. The home stabilization system of claim 2, wherein:

the base assembly comprises a stabilizer plate and a curl bracket mounted to the stabilizer plate;

the lateral transfer strut is pivotably coupled to the curl bracket; and the longitudinal brace is coupled to the stabilizer plate.

5. The home stabilization system of claim 4, wherein:

the curl bracket defines an upper curl bracket portion arranged above ground and a lower curl bracket portion arranged below ground;

the lateral transfer strut is pivotably coupled to the upper curl bracket portion; and the anchor rod is coupled to the lower curl bracket portion.

6. The home stabilization system of claim 5, wherein:

the base assembly further comprises a brace mounting bracket coupled to the stabilizer plate;

the brace mounting bracket defines a bracket fastener opening;

the longitudinal brace defines a brace fastener opening aligned with the bracket fastener opening; and a brace fastener engages each of the bracket fastener opening and the brace fastener opening to couple the longitudinal brace to the stabilizer plate.

7. The home stabilization system of claim 5, wherein:

the upper curl bracket portion defines a first bracket mount hole;

the second transfer strut end of the lateral transfer strut end defines an end slot and a transfer strut opening aligned with the first bracket mount hole;

the upper curl bracket portion engages the end slot; and a first fastener engages each of the first transfer strut opening and the first bracket mount hole to pivotably couple the lateral transfer strut to the upper curl bracket portion.

8. The home stabilization system of claim 7, wherein:

the vertical brace is configured to be arranged at about 90° relative to the ground;

the upper curl bracket portion defines a second bracket mount hole;

the second vertical brace end of the vertical brace defines a vertical brace opening aligned with the second bracket opening; and a second fastener engages each of the vertical brace opening and the second bracket mount hole to couple the vertical brace to the upper curl bracket portion.

9. The home stabilization system of claim 1, further comprising a beam brace, the lateral transfer strut pivotably mounted to the beam brace at the first transfer strut end, the beam brace configured to be coupled to an I-beam of the manufactured home, wherein the beam brace comprises:

a bracket tube;

an upper bracket hook coupled to the bracket tube and configured to hook onto an upper flange of the I-beam; and a lower bracket hook coupled to the bracket tube and configured to hook onto a lower flange of the I-beam opposite the upper flange.

10. The home stabilization system of claim 1, wherein:

the home stabilization system further comprises a toggle bracket;

the toggle bracket is pivotably coupled to the base assembly;

the vertical brace is pivotably coupled to the toggle bracket at the second vertical brace end to pivotably couple the vertical brace to the base assembly; and the lateral transfer strut is pivotably coupled to the toggle bracket at the second transfer strut end to pivotably couple the lateral transfer strut to the base assembly.

11. The home stabilization system of claim 1, wherein the vertical brace is oriented at a smaller angle relative to a vertical direction than an angle of the lateral transfer strut.

12. A building assembly comprising:

a manufactured building mounted above ground and defining a first lateral side and a second lateral side; and a stabilization system mounted between the manufactured building and the ground, the stabilization system comprising a plurality of stabilization assemblies, each stabilization assembly comprising:

a base assembly configured to be mounted to the ground;

a lateral transfer strut pivotably coupled to the manufactured home and pivotably coupled to the base assembly; and a vertical brace pivotably coupled to the manufactured home and pivotably coupled to the base assembly, wherein:

at least one stabilization assembly of the plurality of stabilization assemblies comprises an anchor rod coupled to the base assembly and extending downward from the base assembly into the ground;

the base assembly of the at least one stabilization assembly defines a rod sleeve;

the anchor rod defines an upper rod portion extending through the rod sleeve and a lower rod end distal to the upper rod portion;

an anchor helix is coupled to the anchor rod proximate to the lower rod end;

the upper rod portion of the anchor rod defines a threaded end portion extending through a plate rod opening of the base assembly of the at least one stabilization assembly; and a threaded nut is tightened on to the threaded end portion of the anchor rod to couple the anchor rod to the base assembly of the at least one stabilization assembly.

13. The building assembly of claim 12, wherein a first stabilization assembly of the plurality of stabilization assemblies is attached to a first lateral side of the manufactured building and a second stabilization assembly of the plurality of stabilization assemblies is attached to a second lateral side of the manufactured building opposite from the first lateral side.

14. The building assembly of claim 13, wherein the first lateral side is a windward side and the second lateral side is a leeward side.

15. The building assembly of claim 12, wherein at least one stabilization assembly of the plurality of stabilization assemblies comprises a longitudinal brace coupled to the manufactured home and coupled to the base assembly.

16. The building assembly of claim 12, wherein the base assembly of at least one stabilization assembly of the plurality of stabilization assemblies comprises an anchor and an anchor bracket coupled to the anchor.

17. The building assembly of claim 12, wherein the base assembly of at least one stabilization assembly of the plurality of stabilization assemblies comprises a stabilizer plate and a curl bracket mounted to the stabilizer plate, and wherein the lateral transfer strut of the at least one stabilization assembly is pivotably coupled to the curl bracket.

18. The building assembly of claim 12, wherein each vertical brace is oriented at a smaller angle relative to a vertical direction than an angle of each lateral transfer strut.

19. A home stabilization system comprising:

a base assembly configured to be mounted to a ground;

a lateral transfer strut configured to be pivotably coupled to a manufactured home at a first transfer strut end and pivotably coupled to the base assembly at an opposite second transfer strut end;

a vertical brace configured to be pivotably coupled to a manufactured home at a first vertical brace end and pivotably coupled to the base assembly at an opposite second vertical brace end; and a beam brace, the lateral transfer strut pivotably mounted to the beam brace at the first transfer strut end, the beam brace configured to be coupled to an I-beam of the manufactured home, wherein the beam brace comprises:

a bracket tube;

an upper bracket hook coupled to the bracket tube and configured to hook onto an upper flange of the I-beam; and a lower bracket hook coupled to the bracket tube and configured to hook onto a lower flange of the I-beam opposite the upper flange.

20. A home stabilization system comprising:

a base assembly configured to be mounted to a ground;

a lateral transfer strut configured to be pivotably coupled to a manufactured home at a first transfer strut end and pivotably coupled to the base assembly at an opposite second transfer strut end;

a vertical brace configured to be pivotably coupled to the manufactured home at a first vertical brace end and pivotably coupled to the base assembly at an opposite second vertical brace end; and a longitudinal brace configured to be coupled to the manufactured home at a first longitudinal brace end and coupled to the base assembly at a second longitudinal brace end;

wherein:

the base assembly comprises a stabilizer plate and a curl bracket mounted to the stabilizer plate;

the lateral transfer strut is pivotably coupled to the curl bracket;

the longitudinal brace is coupled to the stabilizer plate; and further comprising an anchor rod coupled to the base assembly and configured to extend downward from the base assembly into the ground, wherein: the curl bracket defines an upper curl bracket portion arranged above ground and a lower curl bracket portion arranged below ground; the lateral transfer strut is pivotably coupled to the upper curl bracket portion; and the anchor rod is coupled to the lower curl bracket portion.

21. The home stabilization system of claim 20, further comprising a longitudinal brace configured to be coupled to the manufactured home at a first longitudinal brace end and coupled to the base assembly at a second longitudinal brace end, wherein:

the base assembly further comprises a brace mounting bracket coupled to the stabilizer plate;

the brace mounting bracket defines a bracket fastener opening;

the longitudinal brace defines a brace fastener opening aligned with the bracket fastener opening; and a brace fastener engages each of the bracket fastener opening and the brace fastener opening to couple the longitudinal brace to the stabilizer plate.

22. The home stabilization system of claim 20, wherein:

the upper curl bracket portion defines a first bracket mount hole;

the second transfer strut end of the lateral transfer strut end defines an end slot and a transfer strut opening aligned with the first bracket mount hole;

the upper curl bracket portion engages the end slot; and a first fastener engages each of the first transfer strut opening and the first bracket mount hole to pivotably couple the lateral transfer strut to the upper curl bracket portion.

23. The home stabilization system of claim 22, wherein:

the vertical brace is configured to be arranged at about 90° relative to the ground;

the upper curl bracket portion defines a second bracket mount hole;

the second vertical brace end of the vertical brace defines a vertical brace opening aligned with the second bracket opening; and a second fastener engages each of the vertical brace opening and the second bracket mount hole to couple the vertical brace to the upper curl bracket portion.

* * * * *